US011732459B2

(12) United States Patent
Bowron

(10) Patent No.: US 11,732,459 B2
(45) Date of Patent: Aug. 22, 2023

(54) LOCATING PIN ASSEMBLY FOR A MODULAR FRAME

(71) Applicant: Z-MODULAR HOLDING, INC., Chicago, IL (US)

(72) Inventor: Julian Bowron, Toronto (CA)

(73) Assignee: Z-MODULAR HOLDING, INC., Chicago, IL (US)

( * ) Notice: Subject to any disclaimer, the term of this patent is extended or adjusted under 35 U.S.C. 154(b) by 0 days.

(21) Appl. No.: 17/258,679

(22) PCT Filed: Jul. 12, 2019

(86) PCT No.: PCT/CA2019/050960

§ 371 (c)(1),
(2) Date: Jan. 7, 2021

(87) PCT Pub. No.: WO2020/010463

PCT Pub. Date: Jan. 16, 2020

(65) Prior Publication Data

US 2021/0277649 A1 Sep. 9, 2021

Related U.S. Application Data

(60) Provisional application No. 62/697,088, filed on Jul. 12, 2018.

(51) Int. Cl.
*E04B 1/24* (2006.01)
*E04B 1/343* (2006.01)
(Continued)

(52) U.S. Cl.
CPC ..... *E04B 1/2403* (2013.01); *E04B 1/3483* (2013.01); *E04B 1/34331* (2013.01);
(Continued)

(58) Field of Classification Search
CPC .. E04B 1/2403; E04B 1/34331; E04B 1/3483; E04B 1/5825; E04B 2001/2406;
(Continued)

(56) References Cited

U.S. PATENT DOCUMENTS 946,423 A 1/1910 Connaty
2,037,736 A 4/1936 Payne et al.
(Continued)

FOREIGN PATENT DOCUMENTS

AU 2014221181 B2 8/2014
AU 2018204197 A1 7/2018
(Continued)

OTHER PUBLICATIONS

Supplementary European search report and written opinion for Application No. 19833475.7 (21 pages). (Year: 2022).*
(Continued)

*Primary Examiner* — Rodney Mintz
(74) *Attorney, Agent, or Firm* — Fitch, Even, Tabin & Flannery, LLP

(57) ABSTRACT

A locating pin assembly for coupling a first modular frame to a second modular frame is disclosed. The locating pin assembly has a first gusset plate positioned between the first modular frame and the second modular frame. The first gusset plate has a first gusset plate aperture and a second gusset plate aperture for receiving fastening means for coupling the first-modular-frame-first-beam and the second-modular-frame-first-beam the gusset plate. The pin assembly also has a pin engaging the first gusset plate, the first modular frame and the second modular frame. Also disclosed are modular frame units having the pin assembly, system of modular frame units having the pin assembly and a method of coupling modular frame units.

9 Claims, 20 Drawing Sheets

(51) Int. Cl.
*E04B 1/348* (2006.01)
*E04B 1/58* (2006.01)

(52) U.S. Cl.
CPC .... *E04B 1/5825* (2013.01); *E04B 2001/2406* (2013.01); *E04B 2001/246* (2013.01); *E04B 2001/2451* (2013.01); *E04B 2001/5856* (2013.01)

(58) Field of Classification Search
CPC ..... E04B 2001/2451; E04B 2001/246; E04B 2001/5856
See application file for complete search history.

(56) References Cited

U.S. PATENT DOCUMENTS

| | | | | |
|---|---|---|---|---|
| 3,205,611 | A | 9/1965 | Onanian | |
| 3,416,270 | A | 12/1968 | McHugh | |
| 3,824,750 | A * | 7/1974 | Antoniou | E04B 1/3483 52/223.4 |
| 3,858,989 | A | 1/1975 | Field | |
| 3,973,855 | A | 8/1976 | Florence | |
| 4,003,144 | A | 1/1977 | Maddestra et al. | |
| D248,447 | S | 7/1978 | Hornung | |
| D258,194 | S | 2/1981 | Stanley | |
| 4,620,404 | A | 11/1986 | Rizk | |
| 4,723,384 | A * | 2/1988 | Mengeringhausen | E04B 1/24 52/646 |
| 4,726,701 | A | 2/1988 | Thomas | |
| 4,758,111 | A | 7/1988 | Vitta | |
| 4,925,330 | A | 5/1990 | Cornish | |
| 5,066,161 | A | 11/1991 | Pinney | |
| 5,127,759 | A | 7/1992 | Orbom | |
| 5,259,685 | A | 10/1993 | Wolf | |
| 5,257,440 | A * | 11/1993 | Bardou | E04B 1/3483 52/656.1 |
| D357,544 | S | 4/1995 | Spransy | |
| 5,414,918 | A | 5/1995 | Pearson | |
| 5,451,115 | A | 9/1995 | Sayres | |
| 5,516,225 | A | 5/1996 | Kvols | |
| 5,556,218 | A | 9/1996 | Homer | |
| 5,590,974 | A | 1/1997 | Yang | |
| 5,605,410 | A | 2/1997 | Pantev | |
| 5,727,358 | A | 3/1998 | Hayashi et al. | |
| 5,816,011 | A | 10/1998 | Kuramoto | |
| 5,820,289 | A | 10/1998 | Kem et al. | |
| 5,904,437 | A | 5/1999 | Allen | |
| 5,921,049 | A | 7/1999 | Sugiyama | |
| 6,062,761 | A | 5/2000 | Allen | |
| 6,092,849 | A | 7/2000 | Zambelli et al. | |
| 6,247,869 | B1 | 6/2001 | Lichvar | |
| 6,332,657 | B1 | 12/2001 | Fischer | |
| 6,334,286 | B1 | 1/2002 | Zambelli et al. | |
| 6,390,719 | B1 | 5/2002 | Chan | |
| 6,974,276 | B2 | 12/2005 | Kirchner et al. | |
| 7,503,623 | B2 | 3/2009 | Favaretto | |
| D622,865 | S | 8/2010 | Bajrami | |
| 7,883,288 | B2 | 2/2011 | Jorna | |
| 7,941,985 | B2 | 5/2011 | Simmons | |
| 8,176,703 | B2 | 5/2012 | Tremacchi | |
| 8,549,796 | B2 * | 10/2013 | Heather | B65D 90/0013 52/745.1 |
| 9,121,433 | B1 | 9/2015 | Bacon | |
| D756,202 | S | 5/2016 | Leduc | |
| 9,334,642 | B1 | 5/2016 | Tanaka et al. | |
| 9,458,619 | B2 | 10/2016 | Bowron et al. | |
| 9,845,595 | B2 | 12/2017 | Bowron | |
| 9,932,734 | B1 | 4/2018 | Winter | |
| 10,036,156 | B1 | 7/2018 | Macdonald et al. | |
| 10,450,737 | B2 | 10/2019 | Bowron | |
| D867,108 | S | 11/2019 | Bowron | |
| 11,098,476 | B2 * | 8/2021 | Jin | E04B 1/2403 |
| 11,230,838 | B1 * | 1/2022 | Mendez-Vazquez | E04B 1/54 |
| 2002/0007614 | A1 | 1/2002 | Katayama et al. | |
| 2005/0034390 | A1 | 2/2005 | Dubensky et al. | |
| 2006/0112657 | A1 | 6/2006 | Abbott-Wilcox | |
| 2009/0087255 | A1 | 4/2009 | Jorna | |
| 2009/0307994 | A1 | 12/2009 | Cathcart et al. | |
| 2011/0219708 | A1 | 9/2011 | Ohnishi et al. | |
| 2011/0265396 | A1 * | 11/2011 | Heather | B65D 90/0026 52/79.9 |
| 2011/0286121 | A1 | 11/2011 | Werner et al. | |
| 2011/0308063 | A1 | 12/2011 | Feeleus | |
| 2013/0045042 | A1 | 2/2013 | Ohlson | |
| 2013/0306808 | A1 | 11/2013 | Huang | |
| 2014/0286695 | A1 | 9/2014 | Jocham et al. | |
| 2014/0294500 | A1 | 10/2014 | Schaff et al. | |
| 2015/0184369 | A1 | 7/2015 | Carless | |
| 2017/0002559 | A1 | 1/2017 | Bowron et al. | |
| 2017/0044753 | A1 | 2/2017 | Bowron | |
| 2017/0089059 | A1 | 3/2017 | Farre Berga | |
| 2018/0127967 | A1 | 5/2018 | Bowron | |
| 2018/0135295 | A1 | 5/2018 | Bowron | |
| 2018/0216336 | A1 | 8/2018 | Macdonald et al. | |
| 2019/0078321 | A1 | 3/2019 | Bowron | |
| 2020/0354950 | A1 | 11/2020 | Bowron | |
| 2021/0207358 | A1 * | 7/2021 | Jin | E04H 9/024 |

FOREIGN PATENT DOCUMENTS

| | | | | |
|---|---|---|---|---|
| CA | 2744074 | A1 | 12/2011 | |
| CN | 1149651 | A | 5/1997 | |
| CN | 2381689 | Y | 6/2000 | |
| CN | 101575876 | A | 11/2009 | |
| CN | 101680227 | A | 3/2010 | |
| CN | 101769008 | A | 7/2010 | |
| CN | 202559534 | U | 11/2012 | |
| CN | 202672346 | U | 1/2013 | |
| CN | 203834666 | U | 9/2014 | |
| CN | 104612250 | A * | 5/2015 | B65D 90/0013 |
| DE | 249688 | A1 | 9/1987 | |
| DE | 19517785 | A1 | 11/1996 | |
| DE | 69704916 | T2 | 11/2001 | |
| EP | 0761895 | A1 | 3/1997 | |
| EP | 1683923 | A2 | 7/2006 | |
| EP | 2759648 | A1 | 7/2014 | |
| EP | 2818429 | A1 * | 12/2014 | B65D 90/0013 |
| EP | 2959067 | A4 | 12/2015 | |
| GB | 2300432 | A | 11/1996 | |
| GB | 2554967 | A | 4/2018 | |
| JP | S52-094009 | U | 7/1977 | |
| JP | S62-031604 | U | 2/1987 | |
| JP | S63-179306 | U | 11/1988 | |
| JP | H03-066303 | U | 6/1991 | |
| JP | H03-224926 | A | 10/1991 | |
| JP | H03233042 | A | 10/1991 | |
| JP | H03267431 | A | 11/1991 | |
| JP | H04-098904 | U | 8/1992 | |
| JP | H04261733 | A | 9/1992 | |
| JP | H0642060 | A | 2/1994 | |
| JP | 3014203 | U | 5/1995 | |
| JP | H07180221 | A | 7/1995 | |
| JP | H07180228 | A | 7/1995 | |
| JP | 3014203 | U | 8/1995 | |
| JP | H07243239 | A | 9/1995 | |
| JP | H09194179 | A | 7/1997 | |
| JP | H09-278352 | A | 10/1997 | |
| JP | H0967869 | | 11/1997 | |
| JP | H10245929 | A | 9/1998 | |
| JP | H10331267 | A | 12/1998 | |
| JP | 2001214530 | A | 8/2001 | |
| JP | 2002081140 | A | 3/2002 | |
| JP | 2003293458 | A | 10/2003 | |
| JP | 2004270438 | A | 9/2004 | |
| JP | 2005139623 | A | 6/2005 | |
| JP | 2006063787 | A | 3/2006 | |
| JP | 2009024419 | A | 2/2009 | |
| JP | 2010112008 | A | 5/2010 | |
| JP | 2010168889 | A | 8/2010 | |
| JP | 2013167131 | A | 8/2013 | |
| JP | 2013245501 | A | 12/2013 | |
| KR | 100923637 | B1 | 10/2009 | |
| KR | 20110053101 | A | 5/2011 | |
| KR | H03267431 | B1 | 2/2013 | |

(56) References Cited

FOREIGN PATENT DOCUMENTS

| | | | |
|---|---|---|---|
| KR | 101676411 | B1 | 11/2016 |
| KR | 20160148659 | A | 12/2016 |
| TW | 294752 | B | 1/1997 |
| WO | 9836134 | A1 | 8/1998 |
| WO | 03069083 | A1 | 8/2003 |
| WO | 2004035952 | A1 | 4/2004 |
| WO | 2006096997 | A1 | 9/2006 |
| WO | 2006122372 | A1 | 11/2006 |
| WO | 2007144913 | A1 | 12/2007 |
| WO | 2010035816 | A1 | 4/2010 |
| WO | 2012083391 | A1 | 6/2012 |
| WO | 2012129601 | A1 | 10/2012 |
| WO | 2014127472 | A1 | 8/2014 |
| WO | 2015164975 | A1 | 11/2015 |
| WO | 2016165022 | A1 | 10/2016 |
| WO | 2017027965 | A1 | 2/2017 |
| WO | 2018132921 | A1 | 7/2018 |
| WO | 2019016617 | A1 | 1/2019 |
| WO | 2019162712 | A1 | 8/2019 |

OTHER PUBLICATIONS

Office Action issued against corresponding EP Patent Application No. 14 754 894.5 dated Apr. 16, 2021 in English (5 pages).
Notice of Grant of Patent issued for corresponding Chinese Patent Application No. 201810153991.5 dated Mar. 30, 2021 with English translation (4 pages).
Office Action issued against corresponding South Korean Patent Application No. 10-2021-7005101 dated Apr. 28, 2021 with English translation (7 pages).
Office Action issued against corresponding Chinese Patent Application No. 201810153991.5 dated Aug. 31, 2020 with English translation (6 pages).
Office Action issued against corresponding Canadian Patent Application No. 2,901,755 dated Oct. 30, 2020 in English (4 pages).
Substantive Examination Clear Report issued against corresponding Malaysian Patent Application No. PI 2015002061 dated Nov. 12, 2020 in English (1 page).
Written Opinion and Search Report issued against corresponding Singaporean Patent Application No. 10201610543Q dated Sep. 8, 2020 in English (10 pages).
Office Action issued against corresponding Chinese Patent Application No. 201880013277.4 dated Oct. 27, 2020 with English translation (42 pages).
Office Action issued against corresponding Chinese Patent Application No. 201680052645.7 dated Feb. 2, 2021 with English translation (5 pages).
Office Action issued against corresponding Australian Patent Application No. 2016308775 dated Feb. 25, 2021 in English (2 pages).
Brazilian Patent Office, Application No. BR112015020099-0; Office Action dated Oct. 6, 2021. (in Portuguese with English translation).
Office Action issued against corresponding JP Patent Application No. 2018-526978 dated Apr. 22, 2021 with English translation (6 pages).
Office Action issued against corresponding CN Patent Application No. 201880013277.4 dated May 27, 2021 with English translation (26 pages).
Office Action issued against corresponding IN Patent Application No. 201917030094 dated May 19, 2021 with English translation (7 pages).
Office Action issued against corresponding MX Patent Application No. MX/a/2017/013296 dated May 17, 2021 with English translation (10 pages).
Office Action issued against corresponding JP Patent Application 2018-505507 dated Jun. 14, 2021 with English translation (6 pages).
Office Action issued against corresponding CA Patent Application No. 2,901,755; dated Sep. 7, 2021 (3 pages).
Office Action issued against corresponding EP Patent Application No. 16836312.5 dated Aug. 27, 2021 (5 pages).
Office Action issued against AU Patent Application No. 2020260531; dated Aug. 19, 2021 (4 pages).
Office Action issued against AU Patent Application No. 2019283912; dated Sep. 27, 2021 (4 pages).
CNIPA, Application No. 201880013277.4; Office Action dated Jan. 21, 2022. (in Chinese with English translation).
EPO; Application No. 18741568.2; Intention to Grant dated Oct. 18, 2021.
JPO; Application No. 2019-540006; Office Action dated Oct. 5, 2021.
International Preliminary Report on Patentability issued for corresponding International Application No. PCT/CA2019/050960 dated Jan. 12, 2021 (4 pages).
International Search Report and Written Opinion for PCT/CA2019/050960 dated Sep. 6, 2019, in English (6 pages).
Extended European Search Report issued against International Application No. PCT/CA2016050954 dated Feb. 14, 2019, in English.
Extended European Search Report issued against International Application No. PCT/CA2014050110 dated Jan. 20, 2017, in English.
Office Action issued against corresponding Japanese Application 2017-508717 dated Feb. 26, 2019 (English translation).
Written Opinion of the International Searching Authority for International Application No. PCT/CA2016/050954 dated Oct. 14, 2016, 8 pages.
International Search Report for International Application No. PCT/CA2016/050954 dated Oct. 14, 2016, 4 pages.
PCT International Search Report for International Application No. PCT/CA2014/050110 dated May 5, 2014, 4 pages.
First Office Action and Search Report for corresponding Chinese Patent Application No. 201680027827.9 dated Apr. 15, 2019 (English translation).
Chinese Office Action dated Jun. 19, 2018.
Office Action issued against corresponding Japanese Patent Application No. JP2015-558313 dated Mar. 6, 2018 (English translation).
International Search Report for PCT/CA2015/050369 dated Jul. 14, 2015 (4 pages).
Office Action issued against corresponding Chinese Application No. 201480022662.7 dated Jul. 18, 2017.
Written Opinion of the International Searching Authority for PCT/CA2015/050369 dated Jul. 14, 2015 (5 pages).
Extended European Search Report issued against corresponding International Application PCT/CA2015050369 dated Nov. 20, 2017.
Written Opinion issued by the Intellectual Property Office of Singapore for corresponding Singapore Application No. 11201506504W dated Mar. 21, 2016 (5 pages).
Written Opinion of the International Searching Authority for PCT/CA2016050434 dated Jun. 23, 2016.
International Search Report for International Application No. PCT/CA2018/050065 dated Apr. 16, 2018, 4 pages.
Written Opinion of the International Searching Authority for PCT/CA2018/050065 dated Apr. 16, 2018, 5 pages.
International Search Report for International Application No. PCT/CA2016/050434 dated Jun. 23, 2016.
Written Opinion of the International Searching Authority for International Application No. PCT/CA2014/050110 dated May 5, 2014.
English translation of Office Action issued against corresponding Japanese patent application 2018-218118, dated Dec. 3, 2019.
Substantive Examination Report issued by the Intellectual Property Corporation of Malaysia against corresponding Malaysian patent application PI 2016001907, dated Jan. 16, 2020.
Examination Report issued by Intellectual Property India against corresponding Indian patent application 201617036767, dated Feb. 21, 2020.
English translation of First Office Action issued against corresponding Japanese patent application 2017-508717, dated Dec. 24, 2019.
Form 2906 issued by EPO against corresponding EPO patent application 14 754 894.5, mailed Nov. 25, 2019 (in English).
IPOS Written Opinion issued against corresponding Singaporean Patent Application No. 11201906602S dated Sep. 4, 2020 in English (7 pages).

(56) References Cited

OTHER PUBLICATIONS

Office Action issued against corresponding Chinese Patent Application No. 201880013277.4 dated Oct. 27, 2020 n Chinese (13 pages).
Office Action issued against corresponding Japanese Patent Application No. 2018-505507 dated Nov. 17, 2020 with English translation (6 pages).
Office Action issued against corresponding Indian Patent Application No. 201817005845 dated Sep. 14, 2020 with English translation (6 pages).
Certificate of Grant issued by IPOS for Singaporean Patent Application No. 11201801190R dated Oct. 14, 2020, in English (3 pages).
Office Action issued against corresponding Brazilian Patent Application No. BR112015020099 dated Jun. 2, 2020 in Portuguese (4 pages).
Office Action issued against corresponding Brazilian Patent Application No. BR112018002870-3 dated Aug. 5, 2020 n Portuguese (4 pages).
Office Action issued against corresponding Chinese Patent Application No. 2016800526457 dated Jun. 9, 2020 in Chinese and English (8 pages).
Office Action issued against corresponding Japanese Patent Application No. 2018-526978 dated Aug. 21, 2020 in Japanese and English (14 pages).
First Examination Report issued against corresponding Australian Patent Application No. 2016247454 dated May 20, 2020 in English (8 pages).
Second Examination Report issued against corresponding Australian Patent Application No. 2016247454 dated Jun. 23, 2020 in English (9 pages).
Office Action issued against corresponding Indonesian Patent Application No. P00201904813 dated Sep. 14, 2020; English translation submitted herewith (4 pages).
Search Report issued against corresponding Brazilian Patent Application No. BR112016025375-2 dated Jul. 12, 2020 with English machine translation (11 pages).
Search Report issued against corresponding Chinese Patent Application No. 2019104842745 dated Oct. 27, 2020 with English translation (11 pages).
Communication under Rule 71(3) EPC issued for corresponding European Patent Application No. 15 785 510.7 dated Aug. 3, 2020 in English (6 pages).
Office Action issued against corresponding Indonesian Patent Application No. P00201607453 dated Apr. 30, 2020 with English machine translation (4 pages).
Office Action issued against corresponding Indonesian Patent Application No. P00201607453 dated Aug. 24, 2020 with English machine translation (4 pages).
Office Action issued against corresponding Japanese Patent Application No. 2017-508717 dated Nov. 24, 2020 with English machine translation (9 pages).
Office Action issued against corresponding Mexican Patent Application No. MX/a/2016/014274 dated Aug. 26, 2020 with English machine translation (6 pages).
Certificate of Grant issued for corresponding Australian Patent Application No. 2018204197 dated Nov. 12, 2020 n English (1 page).
Office Action issued against corresponding Indian Patent Application No. 8541/DELNP/2015 dated Nov. 18, 2020 with English translation (6 pages).
Certificate of Patent issued for corresponding Japanese Patent Application No. 2018-218118 with English translation (10 pages).
Notice of Allowance issued for corresponding Mexican Patent Application No. MX/a/2015/010800 dated Jul. 27, 2020 with English translation (2 pages).
Notice of Allowance issued for corresponding South Korean Patent Application No. 10-2015-7026049 dated Nov. 20, 2020 with English translation (7 pages).
Extended European Search Report issued against corresponding EP Patent Application No. 21152108.3 dated May 4, 2021 in English (7 pages).
Office Action issued against corresponding South Korean Patent Application No. 10-2016-7033280 dated Apr. 26, 2021 in English and Korean (23 pages).
Certificate of Grant issued for corresponding Malaysian Patent Application No. 2016001907 dated Oct. 27, 2020 in English (5 pages).
MPI; Application No. MX/a/2018/001821; Office Action dated Mar. 11, 2022. (Related case; Machine translation).
KIPO; Application No. 10-2019-7024117; Office Action dated Feb. 24, 2022. (Related case; Machine translation).
Office Action dated Aug. 1, 2022, in Chinese Application No. 201980054125.3, together with English language translation thereof (36 pages).
Examination Report dated May 17, 2022, in Brazilian Application No. BR112018002870-3, 9 pages.
Written Opinion dated May 2, 2022, in Singaporean Application No. 11202100236X, 6 pages.
Search and Examination Reports dated Apr. 28, 2022, in United Arab Emirates Application No. P6000248/2018, 12 pages.
Communication dated Mar. 25, 2022, in European Application No. 16836312.5, 4 pages.
Examination Report dated Mar. 16, 2022, in Brazilian Application No. BR112015020099-0, 6 pages.
European Search Report dated Jul. 8, 2022, for European Application No. 22165259.7 (12 pages).
Examination Report dated Jul. 28, 2022, for Indian App. No. 202147003273 (6 pages).
Office Action Issued on basis of Art 35 corresponding Brazilian Patent Application BR112019014771-3 (Portuguese with English translation) dated Nov. 1, 2022.
Office Action Issued against corresponding Mexican Patent Application No. MX/a/2019/008532 (Spanish with English Translation) dated Oct. 19, 2022.
Office Action dated Feb. 2, 2023, in U.S. Appl. No. 17/680,954 (15 pages).
Search Report dated Nov. 30, 2022, in Singapore Application No. 10201900884S (2 pages).
Written Opinion dated Dec. 1, 2022, in Singapore Application No. 10201900884S (6 pages).

* cited by examiner

LOCATING PIN ASSEMBLY FOR A MODULAR FRAME

CROSS-REFERENCE TO RELATED APPLICATIONS

This application is a U.S. national phase application filed under 35 U.S.C. § 371 of International Application No. PCT/CA2019/050960, filed 12 Jul. 2019, designating the United States, which claims priority from U.S. Provisional Application No. 62/697,088, filed 12 Jul. 2018, which are hereby incorporated herein by reference in their entirety for all purposes.

FIELD

The specification relates to a locating pin assembly, a hoistable pin assembly using the locating pin assembly, a method for coupling modular frame units having the locating pin assembly, a method of assembling a modular unit having the locating pin assembly and a building having the locating pin assembly.

BACKGROUND

Modular buildings and modular homes are sectional prefabricated buildings, or houses, that consist of multiple sections called modules. "Modular" is a method of construction differing from other methods of building. The module sections are constructed at an off site (sometimes, remote) facility, then delivered to the intended site of use. Complete construction of the prefabricated sections are completed on site. The prefabricated sections are sometimes lifted and placed on basement walls using a crane, the module prefabricated sections are set onto the building's foundation and joined together to make a single building. The modules can be placed side-by-side, end-to-end, or stacked, allowing a wide variety of configurations and styles in the building layout.

Such prefabricating modular building units constructed from standardized components in a controlled factory setting can be desirable due to the lowered costs and the increased quality which is obtainable in comparison to performing similar work on an outdoor construction job site. Thus prefabricated modular building units having a floor, walls and an overhead structure, and which contain all the systems and furnishings pre-installed within them can be preferred and known in the art. Building assembly systems composed of the means and methods to join two or more modular building units together to form a larger structure are also known in the art.

Devices which engage a specially prepared aperture on the upper or side surface of the structural frame so as to provide a releasable connection for the purpose of lifting, moving and connection of the modular building units are known in the art. For instance, PCT publication numbers WO 2014/127472, WO 2015/164975, WO 2016/165022 and WO 2017/027965, and PCT application number PCT/CA2018/050065 (all incorporated herein by reference and the reader is directed to the relevant sections for further consideration) disclose various connectors for coupling and forming modular building structures.

Although the connectors referred to above can help address a number of issues, in particular, for forming tall, multi-story and slender buildings, there is still a need in the art for connectors for forming short and few-story buildings that can help to reduce the overall cost and increase efficiency in the construction of such buildings.

SUMMARY OF INVENTION

In one aspect, the specification relates to a locating pin assembly for coupling a first modular frame to a second modular frame, the first modular frame having a first-modular-frame-first-hollow-tubular-member and a first-modular-frame-first-beam coupled at a first end of the first-modular-frame-first-hollow-tubular-member, and the second modular frame having a second-modular-frame-first-hollow-tubular-member and a second-modular-frame-first-beam coupled at a first end of the second-modular-frame-first-hollow-tubular-member, the locating pin assembly having:

a first gusset plate positioned between the first modular frame and the second modular frame, the first gusset plate having a first gusset plate aperture and a second gusset plate aperture, the first gusset plate aperture adapted for receiving a first fastening means for coupling the first-modular-frame-first-beam to the first gusset plate, and the second gusset plate aperture adapted for receiving a second fastening means for coupling the second-modular-frame-first-beam to the first gusset plate; and a pin engaging the first gusset plate, the first modular frame and the second modular frame, the pin having a flat quadrilateral-shaped plate like section coupled to a flat inverted conically shaped (or flat inverted V-shaped) section, the flat quadrilateral-type plate like section adapted for engaging the end of the second-modular-frame-first-hollow-tubular-member, and the flat inverted conically shaped section adapted for engaging the end of the first-modular-frame-first-hollow-tubular-member.

In another aspect, the specification relates to a modular frame assembly having:

a first modular frame coupled to a second modular frame with a locating pin assembly sandwiched between the first modular frame and the second modular frame, the first modular frame having a first-modular-frame-first-hollow-tubular-member and a first-modular-frame-first-beam coupled at a first end of the first-modular-frame-first-hollow-tubular-member, and the second modular frame having a second-modular-frame-first-hollow-tubular-member and a second-modular-frame-first-beam coupled at a first end of the second-modular-frame-first-hollow-tubular-member, wherein the locating pin assembly having:

a first gusset plate positioned between the first modular frame and the second modular frame, the first gusset plate having a first gusset plate aperture and a second gusset plate aperture, the first gusset plate aperture adapted for receiving a first fastening means for engaging a first-modular-frame-first-beam-first-aperture for coupling the first-modular-frame-first-beam to the first gusset plate, and the second gusset plate aperture adapted for receiving a second fastening means for engaging a second-modular-frame-first-beam-first-aperture for coupling the second-modular-frame-first-beam to the first gusset plate; and a pin engaging the first gusset plate, the first modular frame and the second modular frame, the pin having a flat quadrilateral-type plate like section coupled to a flat inverted conically shaped section, the flat quadrilateral-type plate like section adapted for engaging the end of the second-modular-frame-first-hollow-tubular-member, and the flat inverted conically shaped section adapted for engaging the end of the first-modular-frame-first-hollow-tubular-member.

In another further aspect, the specification relates to a system of modular frame units for forming a modular building, having a first modular frame coupled to a second modular frame with a locating pin assembly sandwiched between the first modular frame and the second modular frame, wherein the locating pin assembly is as described herein.

In still another aspect, the specification relates to a method of coupling modular frame units for forming a modular building, having coupling a first modular frame to a second modular frame with a locating pin assembly sandwiched between the first modular frame and the second modular frame, wherein the locating pin assembly is as described herein.

In still another further aspect, the specification relates to a hoistable modular frame unit, comprising a locating pin assembly coupled to a first modular frame, wherein the locating pin assembly is as described herein.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Related aspects of applications of the locating pin assembly and the modular units are described in PCT publication numbers WO 2014/127472, WO 2015/164975, WO 2016/165022 and WO 2017/027965, and PCT application number PCT/CA2018/050065 (all incorporated herein by reference) and the reader is directed to the relevant sections for further consideration.

The locating pin assembly, a hoistable pin assembly using the locating pin assembly, a method for coupling modular frame units having the locating pin assembly, a method of assembling a modular unit having the locating pin assembly and a building having the locating pin assembly will be described with reference to the Figures.

Figure 3:
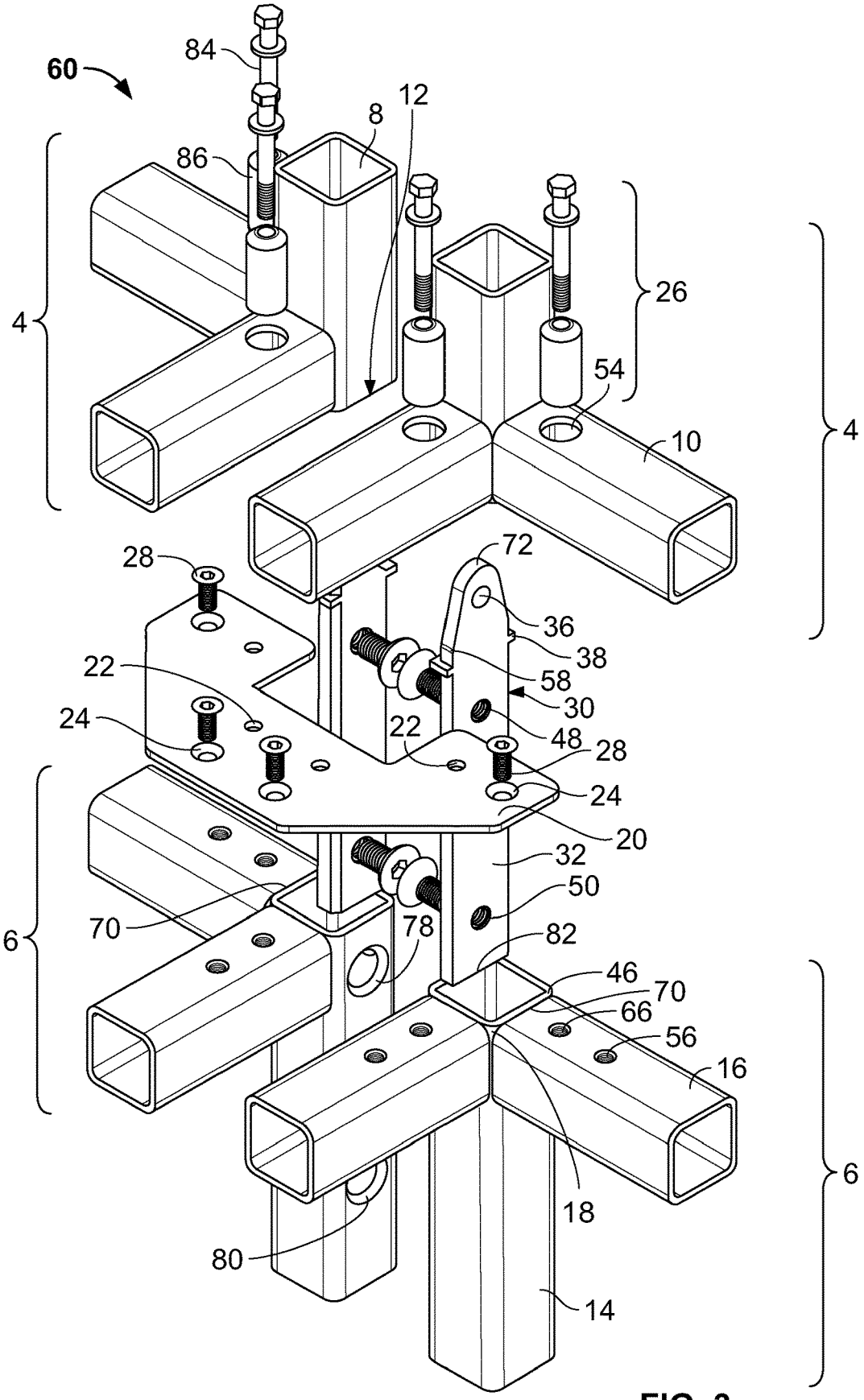
FIG. 3 is an exploded perspective view of an embodiment modular frame assembly having partial section of four modules, along with an embodiment of a locating pin assembly, in accordance with the specification.
Figure 4:
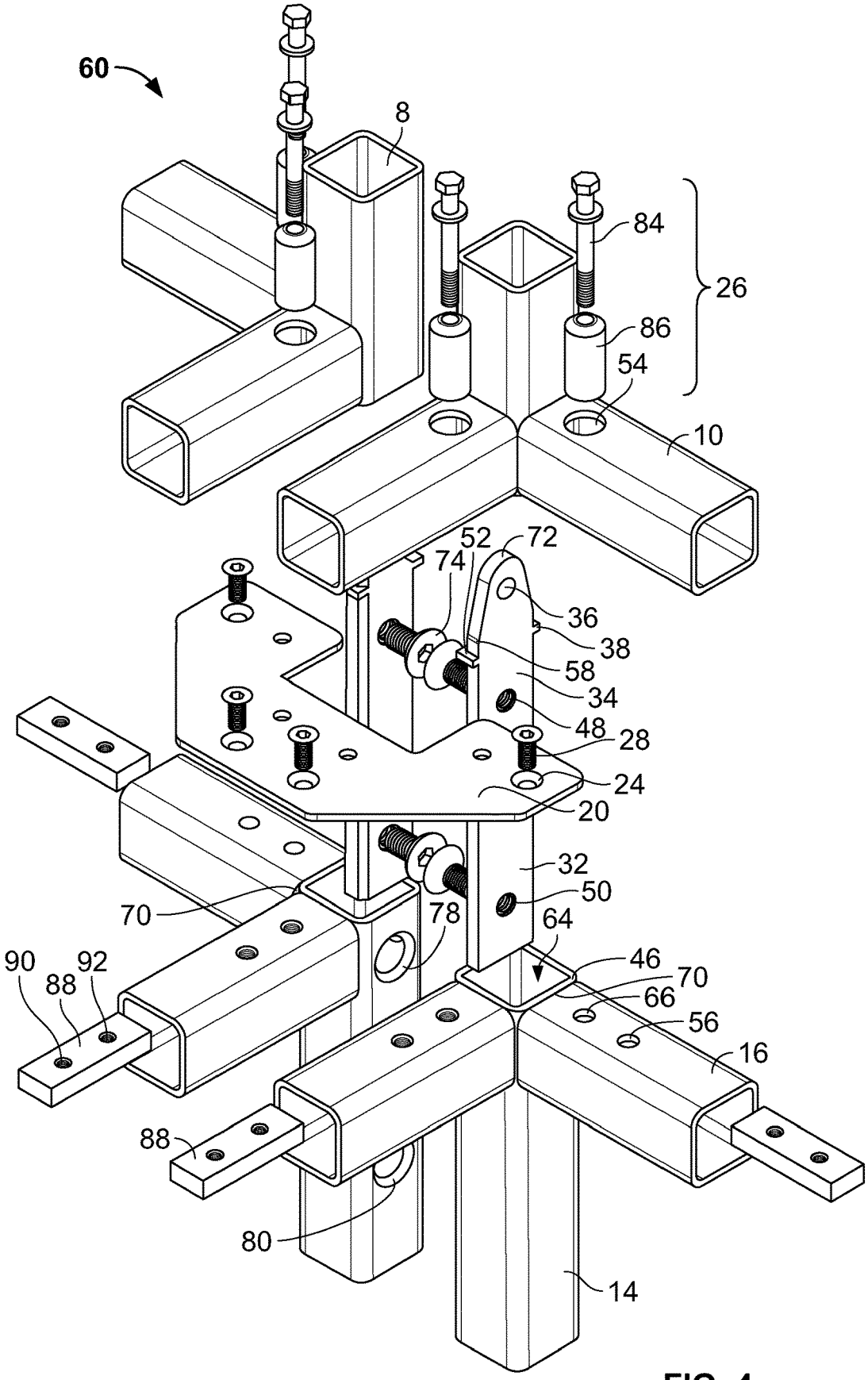
FIG. 4 is an exploded perspective view of an embodiment modular frame assembly of FIG. 3 having weld blocks.
Figure 5:
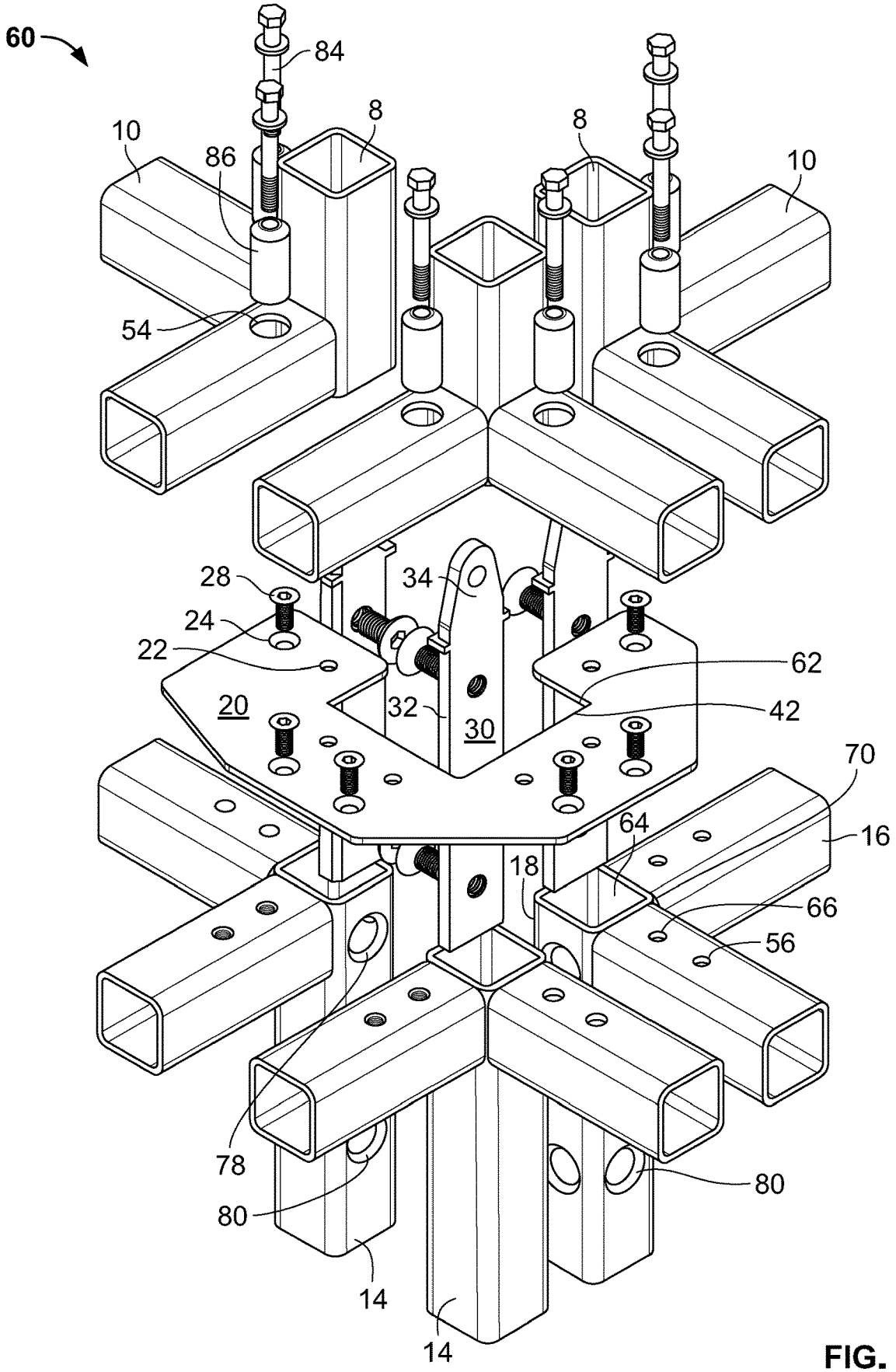
FIG. 5 is an exploded perspective view of an embodiment of a modular frame assembly having partial section of six modules, along with an embodiment of a locating pin assembly, in accordance with the specification.
Figure 6:
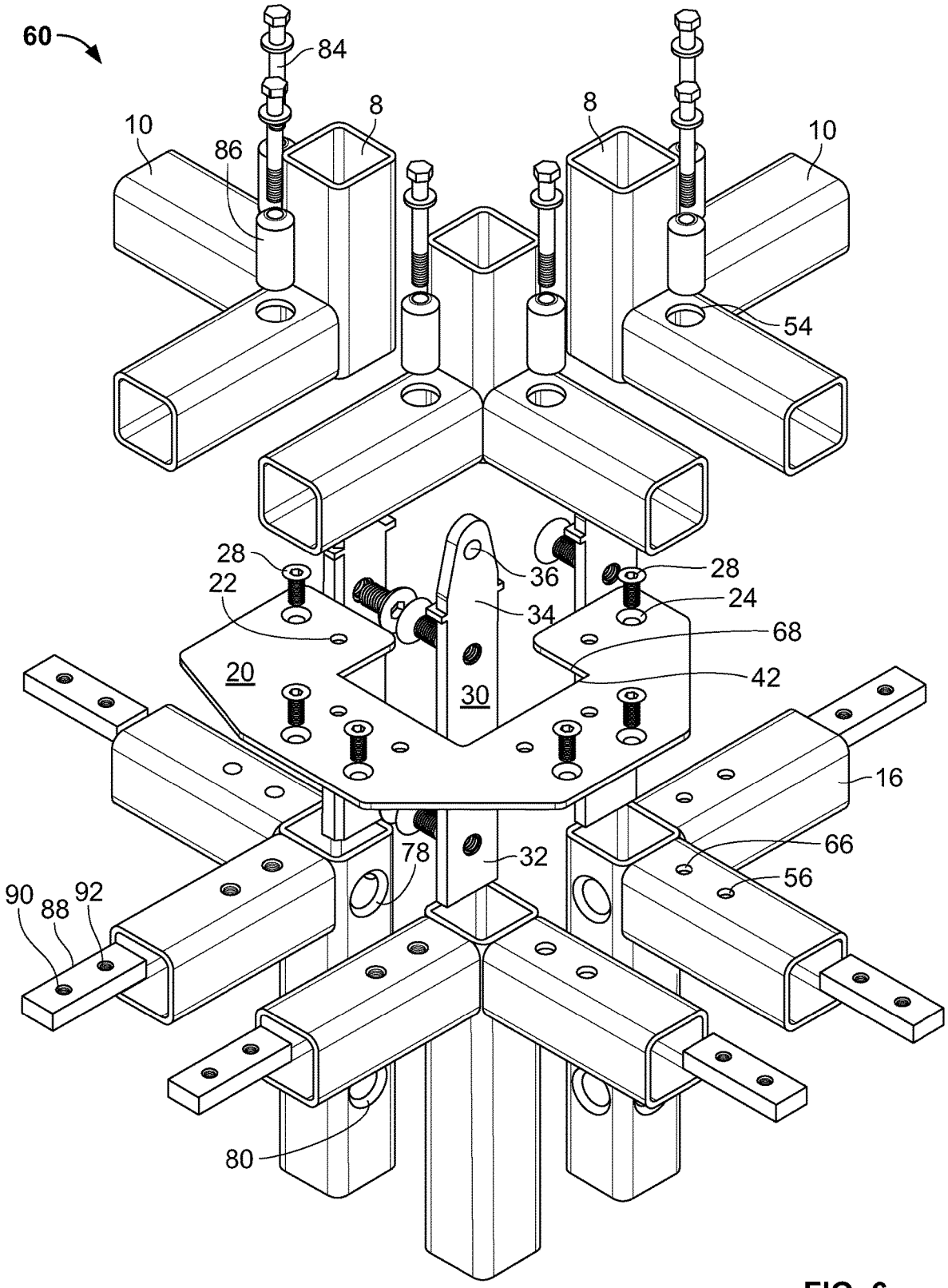
FIG. 6 is an exploded perspective view of an embodiment of a modular frame assembly of FIG. 5 having weld blocks.
Figure 7:
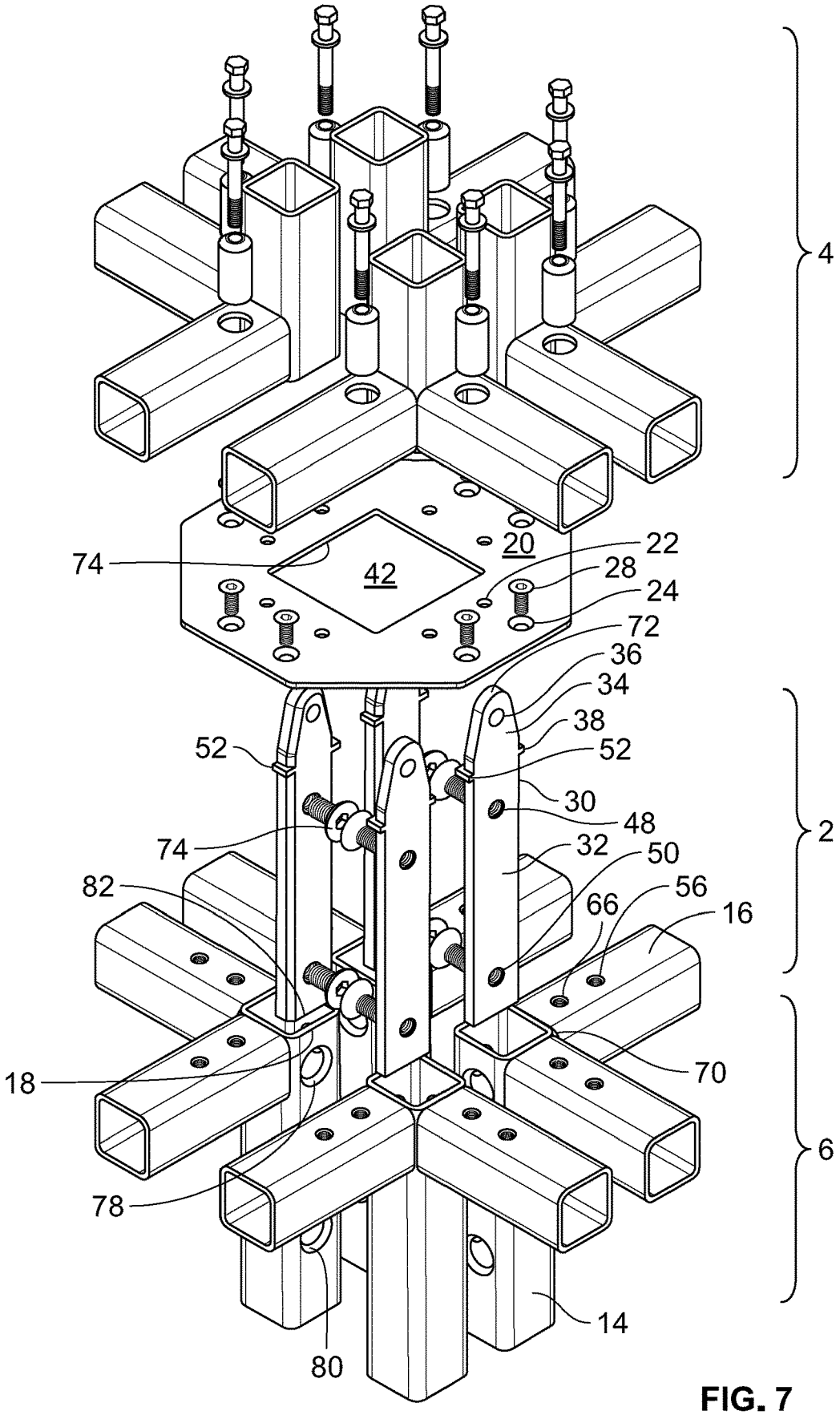
FIG. 7 is an exploded perspective view of an embodiment of a modular frame assembly having partial section of eight modules, along with an embodiment of a locating pin assembly, in accordance with the specification.
Figure 8:
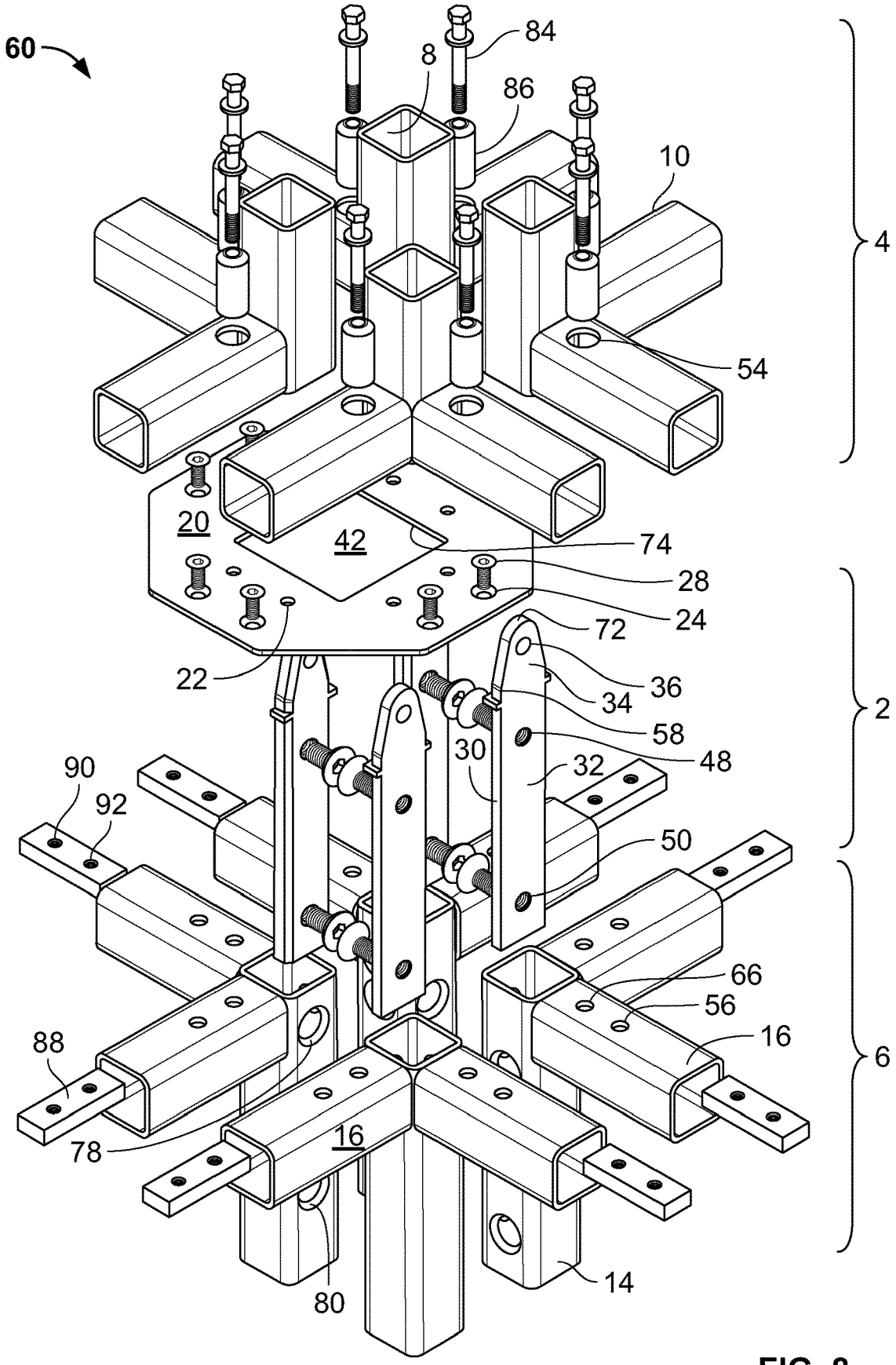
FIG. 8 is an exploded perspective view of an embodiment of a modular frame assembly of FIG. 7 having weld blocks.

FIGS. 1-8 relate an embodiment of a locating pin assembly 2 and FIGS. 9-31 relate to another embodiment of a locating pin assembly 2, where the difference relates to the stop 38 (as described below) in the flat quadrilateral-type plate like section 32 of the pin 30. FIGS. 1, 2, and 14-17 relate to an embodiment of a locating pin assembly 2 having a type of gusset plate 20 used to connect two modules (4, 6), where each module (4, 6) has a pair of perpendicular beams (10, 16). FIGS. 3, 4 and 9-13 relate to an embodiment of a locating pin assembly 2 having a type of gusset plate 20 used to connect four modules (4, 6), where each module (4, 6) has a pair of perpendicular beams (10, 16). FIGS. 5 and 6 relate to an embodiment of a locating pin assembly 2 having a type of gusset plate 20 used to connect six modules (4, 6), where each module (4, 6) has a pair of perpendicular beams (10, 16). FIGS. 7 and 8 relate to an embodiment of a locating pin assembly 2 having a type of gusset plate 20 used to connect eight modules (4, 6), where each module (4, 6) has a pair of perpendicular beams (10, 16). FIGS. 18-22 relate to an embodiment of a locating pin assembly 2 having a type of gusset plate 20 used to connect four modules (4, 6), where each module (4, 6) has a single beam (10 or 16). FIGS. 23-26 relate to an embodiment of a locating pin assembly 2 having a type of gusset plate 20 used to connect two modules (4, 6), where each module (4, 6) has three perpendicular beams (10, 16). FIGS. 27-31 relate to an embodiment of a locating pin assembly 2 having a type of gusset plate 20 used to connect four modules (4, 6), where each module (4, 6) has three perpendicular beams (10, 16). Depending upon the type of the flat quadrilateral-type plate like section 32 of the pin 30 and the type of gusset plate 20 used, different embodiments of the locating pin assemblies 2 can be formed, with each embodiment of the locating pin assembly 2 leading to a different embodiment of a coupled modular frame unit 60.

Figure 1:
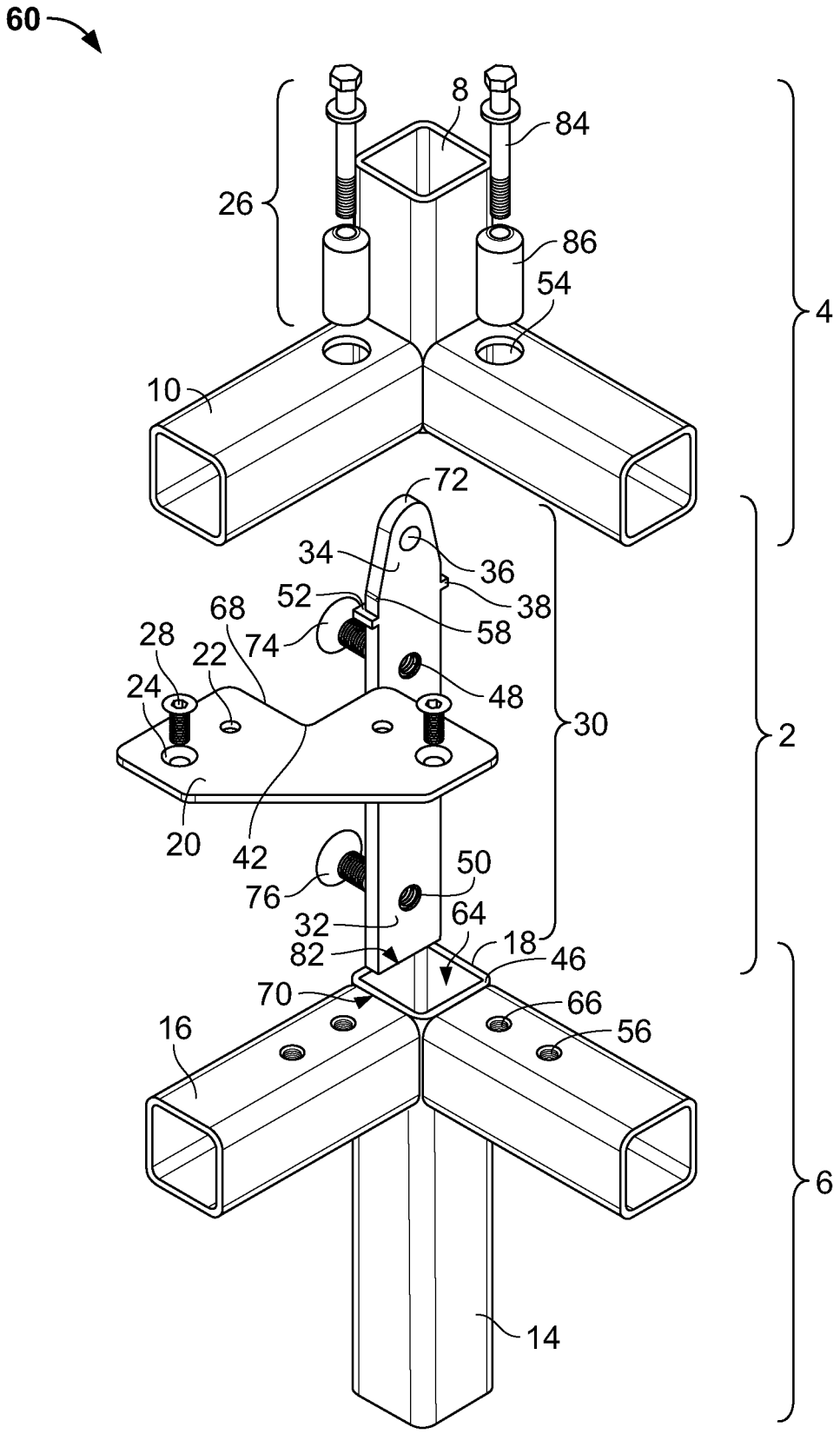
FIG. 1 is an exploded perspective view of an embodiment of a modular frame assembly having partial section of two modules, along with an embodiment of a locating pin assembly, in accordance with the specification.

FIG. 1 discloses an embodiment of a locating pin assembly 2 for coupling a first modular frame 4 to a second modular frame 6. In the figures and specification, while reference is made to a modular frame, for ease of understanding, only a portion of the modular frame is shown. For instance, in FIG. 1, although reference is made to a first modular frame 4, only a corner portion of the first modular frame 4 that is used for coupling to the second modular frame 6 is shown. Similarly, although reference is made to a second modular frame 6, only a corner portion of the second modular frame 6 that is used for coupling to the first modular frame 4 is shown. In the embodiment shown in FIG. 1, a bottom corner of a top modular frame unit is shown as the first modular frame 4, and a top corner of a bottom modular frame unity is shown as the second modular frame 6.

The embodiment of the first modular frame 4 shown in FIG. 1 has a hollow column (noted herein as the first-modular-frame-first-hollow-tubular-member 8). Although the first-modular-frame-first-hollow-tubular-member 8 shown has a rectangular cross-section with rounded edges, other shapes and structures of the first-modular-frame-first-hollow-tubular-member 8 can be used, based on design and application requirements. The first end 12 of the first-modular-frame-first-hollow-tubular-member 8 has an opening 62 to receive the locating pin assembly 2, as described herein.

A pair of beams 10 (noted herein as a first-modular-frame-first-beam) are coupled to the first-modular-frame-first-hollow-tubular-member 8 at the first end 12 of the first-modular-frame-first-hollow-tubular-member 8. The pair of beams 10 (first-modular-frame-first-beam) extending perpendicularly to the first-modular-frame-first-hollow-tubular-member 8 and to each other. In other words, if the first-modular-frame-first-hollow-tubular-member 8 lies in the Z-axis, one of the first-modular-frame-first-beam 10 extends in the X-axis and the other first-modular-frame-first-beam extends in the Y-axis. The method of coupling the first-modular-frame-first-beams 10 to the first-modular-frame-first-hollow-tubular-member 8 is not particularly limited, and should be known to a person of skill in the art. In one embodiment, for example and without limitation, the first-modular-frame-first-beam 10 is welded to the first-modular-frame-first-hollow-tubular-member 8.

Each first-modular-frame-first-beam 10 has an opening 54 (noted herein as a first-modular-frame-first-beam-first-aperture) for receiving fastening means 26 to fasten the first modular frame 4 to the gusset plate 20, as is described herein.

The second modular frame 6 is similar to the first modular frame 4 in structure, but relates to the top end of a lower modular frame, and is provided with features (as described herein) to assist with coupling of the first modular frame 4 to the second modular frame 6, with the gusset plate 20 sandwiched in between the first modular frame 4 and the second modular frame 6.

Like the first modular frame 4, the second modular frame 6 shown in FIG. 1 has a hollow column (noted herein as the second-modular-frame-first-hollow-tubular-member 10). Although the second-modular-frame-first-hollow-tubular-member 10 shown has a rectangular cross-section with rounded edges, other shapes and structures of the second-modular-frame-first-hollow-tubular-member 10 can be used, based on design and application requirements, and so long as they can be used for coupling of the first modular frame 4 to the second modular frame 6. The first end 18 of the second-modular-frame-first-hollow-tubular-member 14 has an opening 64 to receive the locating pin assembly 2, as described herein.

A pair of beams 16 (noted herein as a second-modular-frame-first-beam) are coupled to the second-modular-frame-first-hollow-tubular-member 14 at the first end 18 of the second-modular-frame-first-hollow-tubular-member 14. The pair of beams 16 (second-modular-frame-first-beams) extending perpendicularly to the second-modular-frame-first-hollow-tubular-member 14 and to each other. In other words, if the second-modular-frame-first-hollow-tubular-member 14 lies in the Z-axis, one of the second-modular-frame-first-beam 16 extends in the X-axis and the other second-modular-frame-first-beam 16 extends in the Y-axis. The method of coupling the second-modular-frame-first-beams 16 to the second-modular-frame-first-hollow-tubular-member 14 is not particularly limited, and should be known to a person of skill in the art. In one embodiment, for example and without limitation, the second-modular-frame-first-beam 16 is welded to the second-modular-frame-first-hollow-tubular-member 14.

Each second-modular-frame-first-beam 16 has a pair of openings. The first opening 56 (noted herein as a second-modular-frame-first-beam-first-aperture) for receiving second fastening means 28 to fasten the gusset plate 20 to the second modular frame 6. While the second opening 66 (noted herein as a second-modular-frame-first-beam-second-aperture) for receiving the fastening means 26 that couples the first modular frame 4 to the gusset plate 20 and the second modular frame 6. Hence, the second-modular-frame-first-beam-second-aperture 66 aligns with the first-modular-frame-first-beam-first-aperture 54, and is also sized to receive the fastening means 26 for coupling the first modular frame 4 to the second modular frame 6. In one embodiment, as disclosed in the figures, the first opening 56 formed on the second-modular-frame-first-beam 16 is distal from the second-modular-frame-first-hollow-tubular-member 14, while the second opening 66 being more proximate to the second-modular-frame-first-hollow-tubular-member 14.

To couple the first modular frame 4 to the second modular frame 6, a locating pin assembly 2 is used. The locating pin assembly 2 has a gusset plate 20 (also noted herein as the first gusset plate) and a pin 30.

The gusset plate 20 disclosed herein is a flat plate positioned between the first modular frame 4 and the second modular frame 6, and is provided with features to accommodate the pin 30 and help with coupling of the first modular frame 4 to the second modular frame 6.

In the embodiment shown in FIG. 1, one face of the gusset plate 20 sits on and contacts each of the second-modular-frame-first-beams 16. Hence, the gusset plate 20 used in the embodiment shown in FIG. 1 is sized to be placed on two perpendicular second-modular-frame-first-beams 16. In addition, in one embodiment, for example and without limitation, the gusset plate 20 is sized so that it contacts the entire width of the second-modular-frame-first-beam 16 on which the gusset plate 20 sits.

The gusset plate 20 is provided with a first gusset plate aperture 22 and a second gusset plate aperture 24. The first gusset plate aperture 22 and second gusset plate aperture 24 are formed in the gusset plate 20 so that they align with the second-modular-frame-first-beam-second-aperture 66 and the second-modular-frame-first-beam-first-aperture 56, respectively. In other words, the first gusset plate aperture 22 aligns with the second-modular-frame-first-beam-second-aperture 66, and the second gusset plate aperture 24 aligns with the second-modular-frame-first-beam-first-aperture 56.

In addition, the first gusset plate aperture 22 is formed to also align with the first-modular-frame-first-beam-first-aperture 54. Hence, when fastening means 26 is used for coupling the first modular frame 4 to the second modular frame 6, the fastening means 26 engages the first-modular-frame-first-beam-first-aperture 54, the first gusset plate aperture 22 and the second-modular-frame-first-beam-second-aperture 66 to affix and couple the first modular frame 4 to the second modular frame 6.

Furthermore, when second fastening means 28 are used to couple the gusset plate 20 with the second modular frame 6, the second fastening means 28 engages the second gusset plate aperture 24 and the second-modular-frame-first-beam-first-aperture 56 for coupling the gusset plate 20 with the second modular frame 6. By providing the gusset plate 20 with the second gusset plate aperture 24, the gusset plate 20 can be aligned, positioned and coupled to the second modular frame 6 prior to coupling of the first modular frame 4 to the second modular frame 6, and assist in manufacturing a modular structure.

The thickness of the gusset plate 20 is not particularly limited and can be varied depending upon design and application requirements. In a particular embodiment, the gusset plate 20 has a thickness equal to the thickness of a stop 38 (as described herein) provided on the pin 30, so that the gusset plate 20 and the stop 38 provide a surface of uniform surface between the first modular frame 4 and the second modular frame 6.

The gusset plate 20 is also provided with a cutout 42 for receiving and positioning of the pin 30 in the second-modular-frame-first-hollow-tubular-member 14. In the embodiment shown in FIG. 1, the gusset plate 20 has a V-shaped cutout 42 to receive the pin 30. In a particular embodiment, for example and without limitation, the cutout 42 on the gusset plate 20 is sized such that an edge 68 of the gusset plate 20 aligns with an edge 70 of the second-modular-frame-first-beam 16. By sizing the cutout 42 as such, the edge 68 of the gusset plate 20 that defines the cutout 42 avoids sitting on or contacting an edge 46 at a first end 18 of the second-modular-frame-first-hollow-tubular-member 14. This can assist in insertion and positioning of the pin 30 in the opening 64 at the first end 18 of the second-modular-frame-first-hollow-tubular-member 14, and also assist in providing the space for the stop 38 to be positioned on the edge 46 at a first end 18 of the second-modular-frame-first-hollow-tubular-member 14 to ensure proper positioning of the pin 30 in the second-modular-frame-first-hollow-tubular-member 14.

The pin 30 in the pin assembly 2 engages the first gusset plate 20, the first modular frame 4 and the second modular frame 6. In the embodiment disclosed herein, the pin 30 is generally flat and elongated, and has a flat quadrilateral-type plate like section 32 and a flat inverted conically shaped section 34. In other words, the flat conically shaped section is analogous to an inverted V-shaped flat section, with the apex of the V-shaped section being distal from the flat quadrilateral-shaped plate like section 32. The flat inverted conically shaped (or V-shaped) section 34 is coupled to the flat quadrilateral-type plate like section 32 at a first end 58 of the flat quadrilateral-type plate like section 32, with the apex 72 of the flat inverted conically shaped section 34 positioned away from the first end 58 of the flat quadrilateral-type plate like section 32. The apex 72 of the flat inverted conically shaped (or flat inverted V-shaped) section 34 is not particularly limited in shape, and in one embodiment, is formed by tapering of the lateral edges to an apex, which can be rounded.

Figure 13:
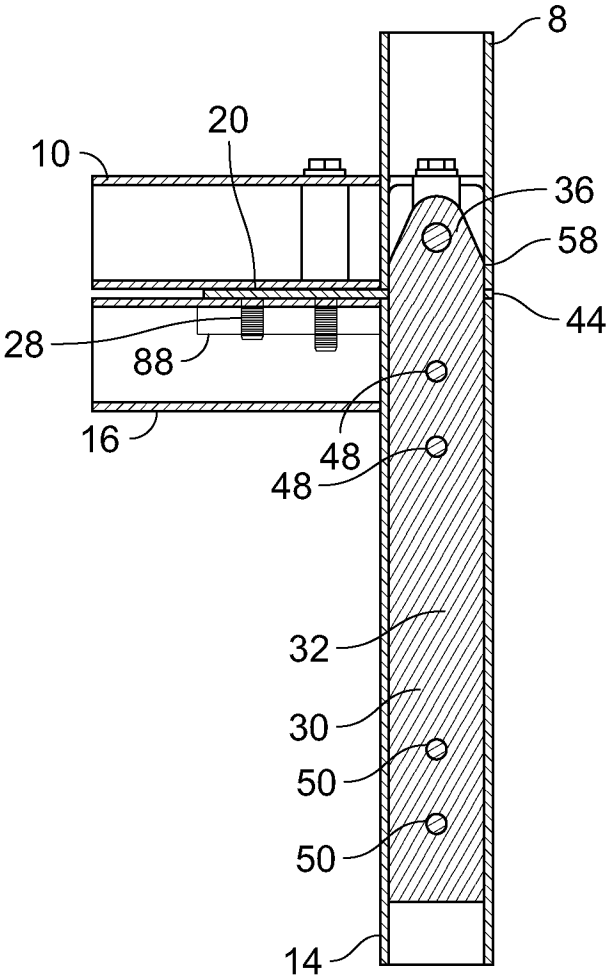
FIG. 13 is a plan second side view of a modular frame assembly shown in FIG. 9.
Figure 12:
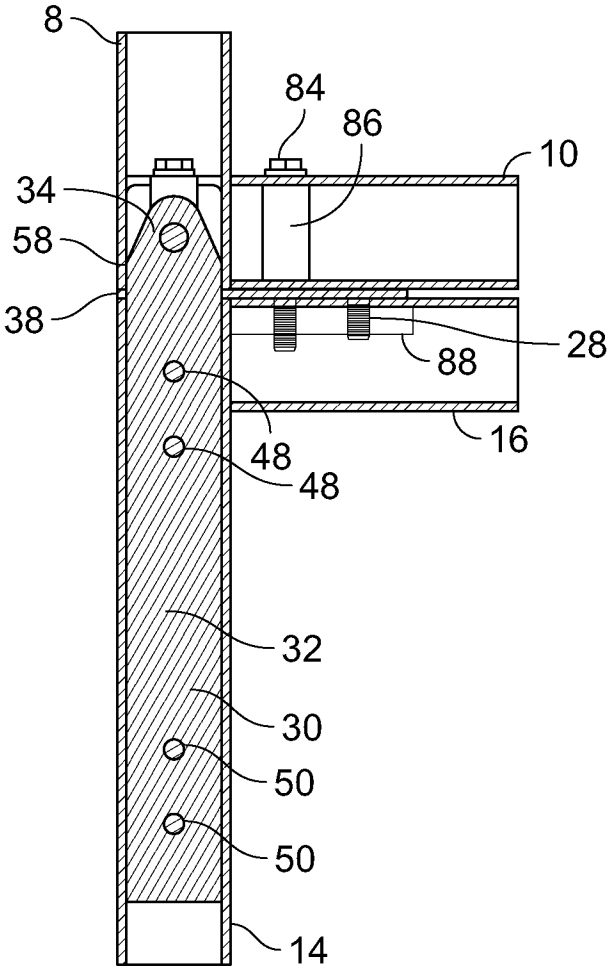
FIG. 12 is an elevational first side view of a modular frame assembly shown in FIG. 9.
Figure 15:
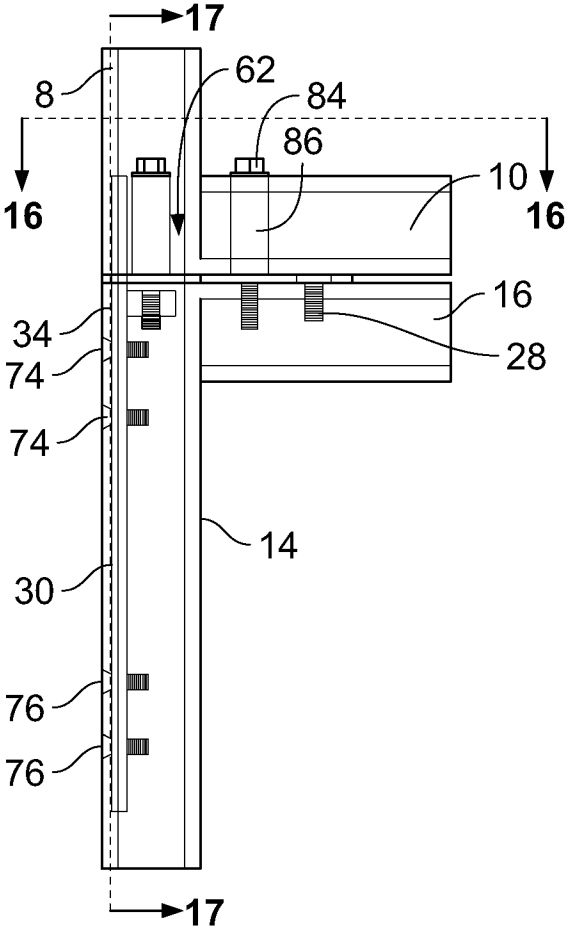
FIG. 15 is an elevational right side view of a modular frame assembly as shown in FIG. 14.
Figure 14:
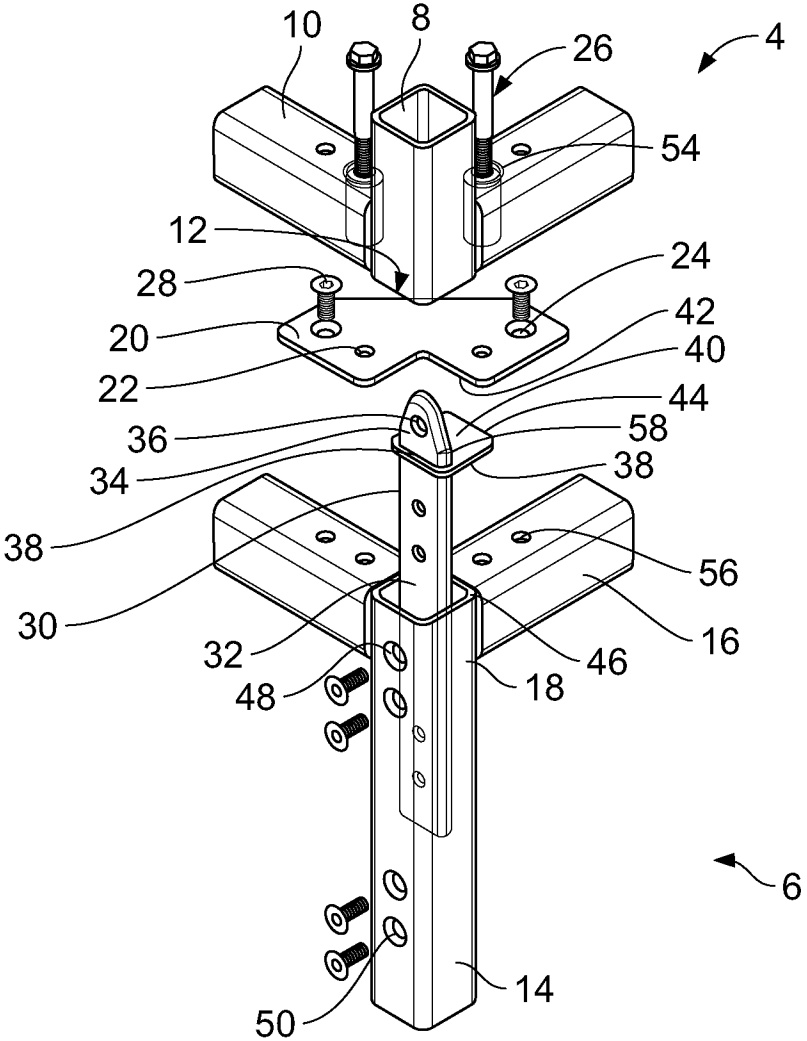
FIG. 14 is an exploded perspective view of another embodiment of a modular frame assembly having partial section of two modules, along with another embodiment of a locating pin assembly, in accordance with the specification.
Figure 17:
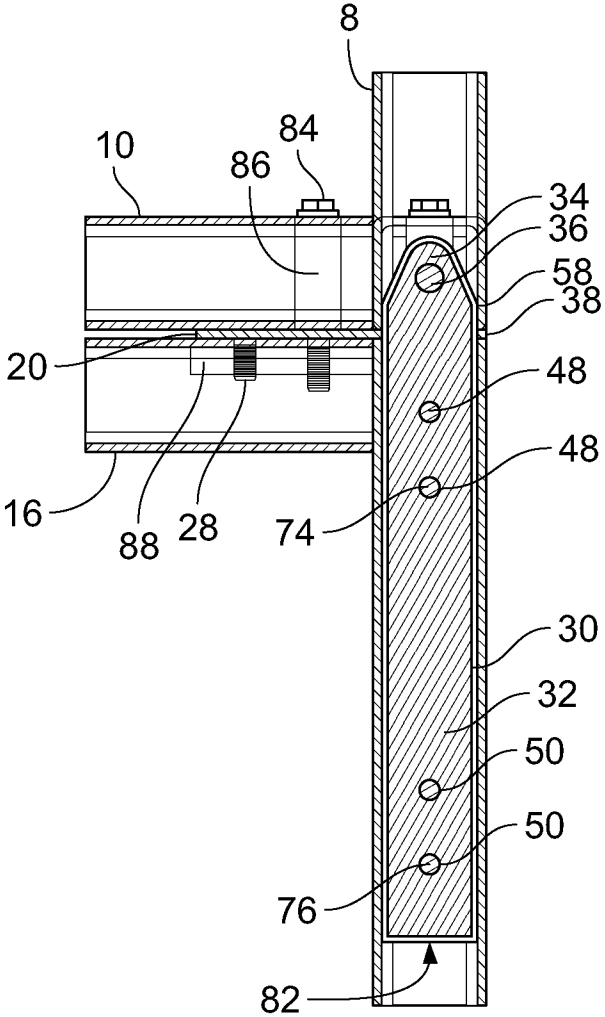
FIG. 17 is an elevational back view of a modular frame assembly as shown in FIG. 14.
Figure 16:
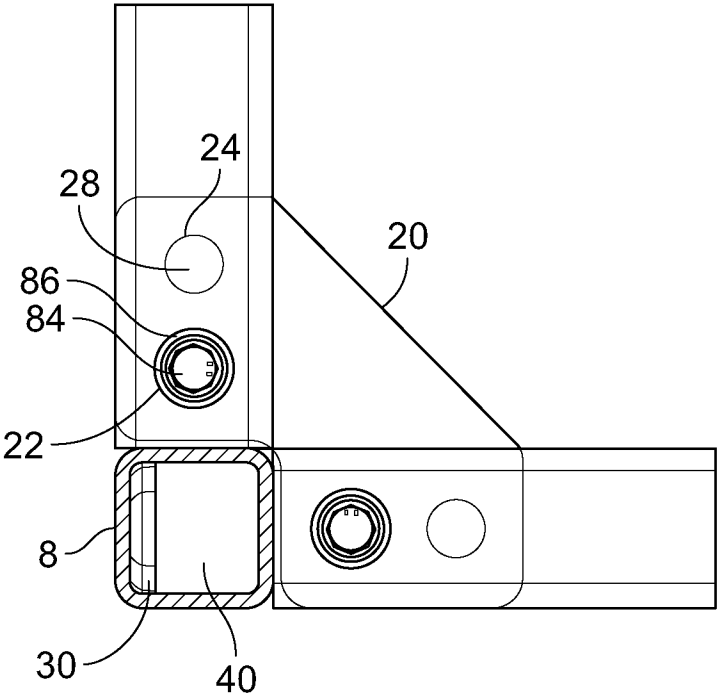
FIG. 16 is a plan view of a modular frame assembly shown in FIG. 14.

The shape and size of the flat quadrilateral-type plate like section 32 is not particularly limited, and can be varied, depending upon design and application requirements. In one embodiment, for example and without limitation, the flat quadrilateral-type plate like section 32 is generally shaped as a rectangular cube, with the flat inverted conically shaped (or V-shaped) section 34 extending from the first end 58 of the flat quadrilateral-type plate like section 32. When coupling the pin 30 with the second-modular-frame-first-hollow-tubular-member 14, the flat quadrilateral-type plate like section 32 contacts only one inner face of the second-modular-frame-first-hollow-tubular-member 14 (as shown in the figures), while being spaced from an opposing inner face of the second-modular-frame-first-hollow-tubular-member 14, where the quadrilateral-type plate like section 32 is inserted. In a further embodiment, as shown in FIGS. 12 and 13, the width of the flat quadrilateral-type plate like section 32 is nearly the same as the width of the inner face of the second-modular-frame-first-hollow-tubular-member 14, such that the flat quadrilateral-type plate like section 32 contacts three inner faces of the second-modular-frame-first-hollow-tubular-member 14.

In one embodiment, as disclosed herein, to couple and affix the pin 30 to the second-modular-frame-first-hollow-tubular-member 14, the flat quadrilateral-type plate like section 32 of the pin 30 is provided with a first orifice 48 and a second orifice 50, adapted and sized to receive third fastening means 74 and fourth fastening means 76, respectively, to couple the pin 30 to the second-modular-frame-first-hollow-tubular-member 14. To achieve the coupling, the second-modular-frame-first-hollow-tubular-member 14 is provided with a first opening 78 (noted herein as a second-modular-frame-first-hollow-tubular-member-first-opening) and a second opening 80 (noted herein as a second-modular-frame-first-hollow-tubular-member-second-opening). In a particular embodiment, for example and without limitation, as shown in FIG. 1, the first orifice 48 is formed in between the stop 38 and a second end 82 of the flat quadrilateral-type plate like section 32 of the pin 30, and also being proximate to the stop 38 or first end 58 of flat quadrilateral-type plate like section 32 of the pin 30. While the second orifice 50 is formed proximate to the second end 82 of the flat quadrilateral-type plate like section 32 of the pin 30.

When the flat quadrilateral-type plate like section 32 of the pin 30 is inserted into the opening 64 at the first end 18 of the second-modular-frame-first-hollow-tubular-member 14, the stop 38 helps position the flat quadrilateral-type plate like section 32 such that the first orifice 48 aligns with the second-modular-frame-first-hollow-tubular-member-first-opening 78 and the second orifice 50 aligns with second-modular-frame-first-hollow-tubular-member-second-opening 80. Third fastening means 74 can then be inserted into the second-modular-frame-first-hollow-tubular-member-first-opening 78, and the fourth fastening means 76 can be inserted into the second-modular-frame-first-hollow-tubular-member-second-opening 80 to couple and affix the pin 30 in place in the second-modular-frame-first-hollow-tubular-member 14.

As noted above, the pin 30 is provided with a stop 38 on the flat quadrilateral-type plate like section 32 of the pin 30, with the stop 38 being positioned close to the first end 58 of the flat quadrilateral-type plate like section 32. The shape and size of the stop 38 is not particularly limited and can be varied depending upon design and application requirements, so long as the stop can help with positioning of the pin 30 in the second-modular-frame-first-hollow-tubular-member 14 or with alignment of the orifices (48, 50) with the first and second apertures (78, 80) in the second-modular-frame-first-hollow-tubular-member 14.

In one embodiment, for example and without limitation, as shown in FIGS. 1-8, stop 38 is formed by a pair of ledges 52 that extend laterally outward from the lateral face of the flat quadrilateral-type plate like section 32 of the pin 30. When the pin 30 is positioned in the opening 64 at the first end 18 of the second-modular-frame-first-hollow-tubular-member 14, the pair of ledges 52 contact and sit on opposing edges 46 at the first end 18 of the second-modular-frame-first-hollow-tubular-member 14. This can help with proper positioning of the pin 30 in the second-modular-frame-first-hollow-tubular-member 14 and can also help with alignment of the orifices (48, 50) for coupling of the pin 30 to the second-modular-frame-first-hollow-tubular-member 14.

In a particular embodiment, the stop 38 has a thickness that equals the thickness of the gusset plate 20, such that when pin 30 and the gusset plate 20 are placed in position on the second modular frame 6, the gusset plate 20 and the stop 38 lie in a single plane. This can help with proper alignment of modular frames (4, 6) and to help avoid tilting of the modular assembly.

As noted above, the pin 30 is also provided with a flat inverted conically shaped section 34 which is inserted into an opening 62 at the first end 12 of the first-modular-frame-first-hollow-tubular-member 8. Although it is not absolutely necessary to provide tapered section that extends beyond the first end 58 of the flat quadrilateral-type plate like section 32 and gets inserted into the opening 62 at the first end 12 of the first-modular-frame-first-hollow-tubular-member 8, tapering of the section to form the flat inverted conically shaped section 34 can help with ease in alignment, insertion and coupling of the first modular frame 4 to the second modular frame 6.

In one embodiment, as disclosed herein, the flat inverted conically shaped section 34 is provided with a hoisting aperture 36. The hoisting aperture 36 being formed proximate to the apex 72 of the flat inverted conically shaped section 34. When the pin 30 is coupled to the second modular frame 6, the hoisting aperture 36 on the flat inverted conically shaped section 34 of the pin 30 can be used for hoisting the second modular frame 6 and positioning it at the appropriate site of construction of the modular assembly before the first modular frame 4 is positioned on the second modular frame 6.

In addition to the above, although not shown, the hoisting aperture 36 can be used to affix the flat inverted conically shaped section 34 of the pin 30 to the first-modular-frame-first-hollow-tubular-member 8, by forming an aperture near the first end 12 of the first-modular-frame-first-hollow-tubular-member 8 that aligns with the hoisting aperture 36 once the flat inverted conically shaped section 34 of the pin 30 is inserted into the opening 62 at the first end 12 of the first-modular-frame-first-hollow-tubular-member 8.

The fastening means (26, 28, 74, 76) used to couple and fasten the different parts of the locating pin assembly 2 and modular frames (4, 6) together are not particularly limited and can be varied depending upon design and application requirements. In one embodiment, for example and without limitation, the second, third and fourth fastening means are flat head screws. In another embodiment, for example and without limitation, the first fastening means are formed using a threaded bolt 84 and a compression sleeve 86. Use of a compression sleeve 86 in the first-modular-frame-first-beam 10 can help avoid compression of first-modular-frame-first-beam 10 and assist with proper coupling of the first modular frame 4 to the second modular frame 6.

Figure 2:
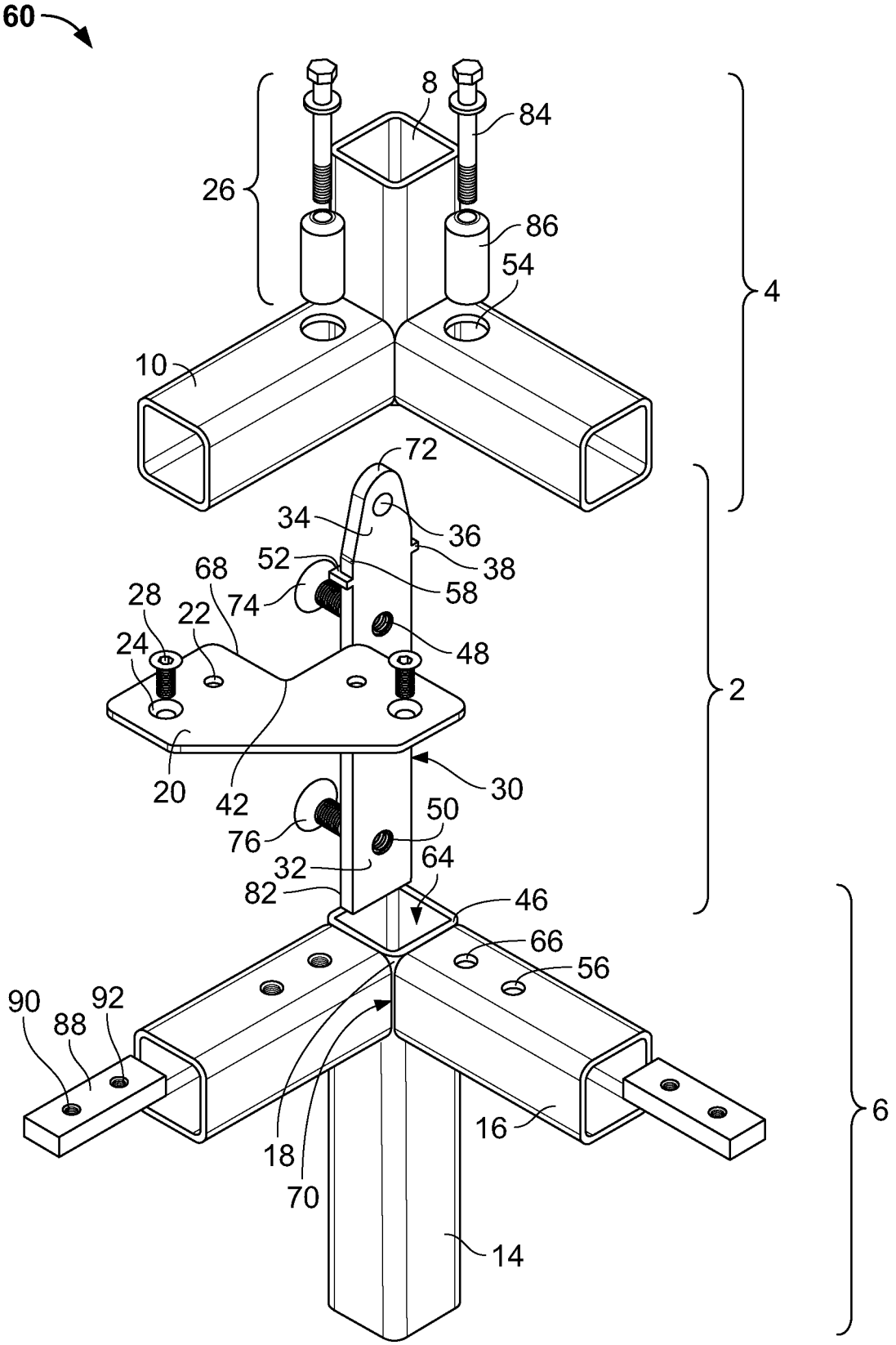
FIG. 2 is an exploded perspective view of an embodiment of a modular frame assembly of FIG. 1 having weld blocks.

FIG. 2 relates to an embodiment of a locating pin assembly 2 similar to the FIG. 1. However, the embodiment shown in FIG. 2 is provided with a weld block 88 that can help to increase structural integrity and coupling of the first frame 4 to the second frame 6, and can also help avoid compression of the second-modular-frame-first-beam 16. The weld block 88 is provided with a weld block first aperture 90 and a weld block second aperture 92. The weld block first aperture 90 can align with the second-modular-frame-first-beam-first-aperture 56 to receive second fastening means 28 to affix the gusset plate 20 to the second modular frame 6. While the weld block second aperture 92 can align with the second-modular-frame-first-beam-second-aperture 66 to receive first fastening means 26 to affix the first modular frame 4 to the second modular frame 6.

In one embodiment, as shown herein, the columns (8, 14) and beams (10, 16) in the modular frames (4, 6) are made of hollow structural sections (HSS). The weld blocks 88 disclosed herein can help to provide structural support to the HSS and/or can help to avoid compression of the second-modular-frame-first-beam 16 when coupling the first modular frame 4 to the second modular frame 6. In an alternative embodiment, non-HSS structures can be used; however, such structural members may not be preferred due to cost considerations.

FIGS. 3 and 4 relates to another embodiment of a locating pin assembly 2 and a modular assembly, where a pair of first modular frames 4 are coupled to a pair of second modular frames 6 that are adjacent to each other. In such an embodiment, a pair of pins 30 are used to form the modular assembly. One pin 30 coupling one first modular frame 4 to one second modular frame 6, while another pin 30 couples another first modular frame 4 to another second modular frame 6.

The gusset plate 20 disclosed in the embodiment of FIGS. 3 and 4 has a half octagon shape. The gusset plate 20 sits on and contacts each of the beams (10, 16) of the two first modular frames 4 and the two second modular frames 6, similar to the embodiment shown in FIG. 1.

The gusset plate 20 is also provided with a plurality of first and second gusset plate apertures (22, 24) that function analogous to the first and second gusset plate apertures (22, 24) shown in FIG. 1. Hence, each of the first gusset plate aperture 22 is adapted to receive a first fastening means to couple each of the first-modular-frame-first-beam 10 to the gusset plate 20 and its corresponding and aligning second-modular-frame-first-beam 16.

Further, the gusset plate 20 is also provided with a cutout 42 sized to receive the pair of pins 30 for coupling the first modular frame 4 to the second modular frame 6. In addition, the cutout 42 is sized such that the edge 68 of the cutout 42 aligns with edges 70 of the second-modular-frame-first-beam 16, to accommodate positioning of the pins 30 in the second-modular-frame-first-hollow-tubular-member 14.

The embodiment shown in FIG. 4 relates to an embodiment of FIG. 3, where the modular assembly is provided with weld blocks 88 analogous to the weld blocks 88 shown in FIG. 2.

FIGS. 5 and 6 relate to another embodiment of a locating pin assembly 2 and a modular assembly, where a three sets of first modular frames 4 are coupled to three sets of corresponding second modular frames 6 that are adjacent to each other. In such an embodiment, a three pins 30 are used to form the modular assembly, with one pin 30 being used to couple one of the first modular frame 4 in each set with one of the second module frame 6, positioned below in the first modular frame 4.

The gusset plate 20 disclosed in FIGS. 5 and 6 are shaped as three quarters of an octagon, and helps to affix a first set of the first and second modular frames (4, 6) to the second and third set of the first and second modular frames (4, 6). In this manner, all sets of the first and second modular frames (4, 6) are affixed to one another to form the modular assembly.

The embodiment shown in FIG. 6 relates to an embodiment of FIG. 5, where the modular assembly is provided with weld blocks 88 analogous to the weld blocks 88 shown in FIG. 2.

FIGS. 7 and 8 relate to another embodiment of a modular assembly where four adjacent first and second modular frame units (4, 6) are positioned and coupled to one another. Four pins 30 are used, with each pin 30 coupling a first modular frame 4 to a second modular frame 6, analogous to the embodiment shown in FIG. 1.

The gusset plate 20 shown in FIGS. 7 and 8 is octagonal in shape with the cutout 42 being formed as a square hole in the gusset plate 20 for receiving the pins 30. As in the previous embodiments, the gusset plate 20 helps to affix a first set of the first and second modular frames (4, 6) to the second, third and fourth sets of the first and second modular frames (4, 6). In this manner, all sets of the first and second modular frames (4, 6) are affixed to one another to form the modular assembly.

FIGS. 9-31 relate to embodiments of modular assemblies 60 where a different embodiment of the pin 30 is used compared to the pin 30 used in the embodiments shown in FIGS. 1-8.

In the embodiments shown in FIGS. 9-31, the pin 30 has a stop 38 formed as a planar stop plate 40. Similar to the ledge 52 forming the stop 38 in the embodiments shown in FIGS. 1-8, the planar stop plate 40 is positioned on the flat quadrilateral-type plate like section 32 near the first end 58 of the flat quadrilateral-type plate like section 32. Hence, the position of the planar stop plate 40 in the embodiments shown in FIGS. 9-31 is similar to the ledge 52 shown in the embodiments shown in FIGS. 1-8.

The planar stop plate 40 shown in the embodiments of FIGS. 9-31 is planar and extends perpendicularly from the flat quadrilateral-type plate like section 32. The thickness of the planar stop plate 40 can be similar or the same as the gusset plate 20. In addition, the planar stop plate 40 can be sized such that the one or more edges 44 of the planar stop plate 40 aligns with one or more edges 46 at the first end 18 of the second-modular-frame-first-hollow-tubular-member 14, so long as the planar stop plate 40 can assist with alignment and positioning of the pin 30 in the opening 64 at the first end 18 of the second-modular-frame-first-hollow-tubular-member 14. In a particular embodiment, for example and without limitation, the planar stop plate 40 is square shaped with all four edges 44 of the planar stop plate 40 aligning and contacting with all four edges 46 at the first end 18 of the second-modular-frame-first-hollow-tubular-member 14 that has a square cross-section. Such an embodiment can help with ease in positioning and alignment of the pin 30 in the opening 64 at the first end 18 of the second-modular-frame-first-hollow-tubular-member 14. In addition, when such an embodiment is placed in position, the gusset plate 30 and the planar stop plate 40 can provide a near continuous planar surface between the first modular frame 4 and the second modular frame 6, which can help with providing increased structural stability to the modular assembly 60.

Figure 10:
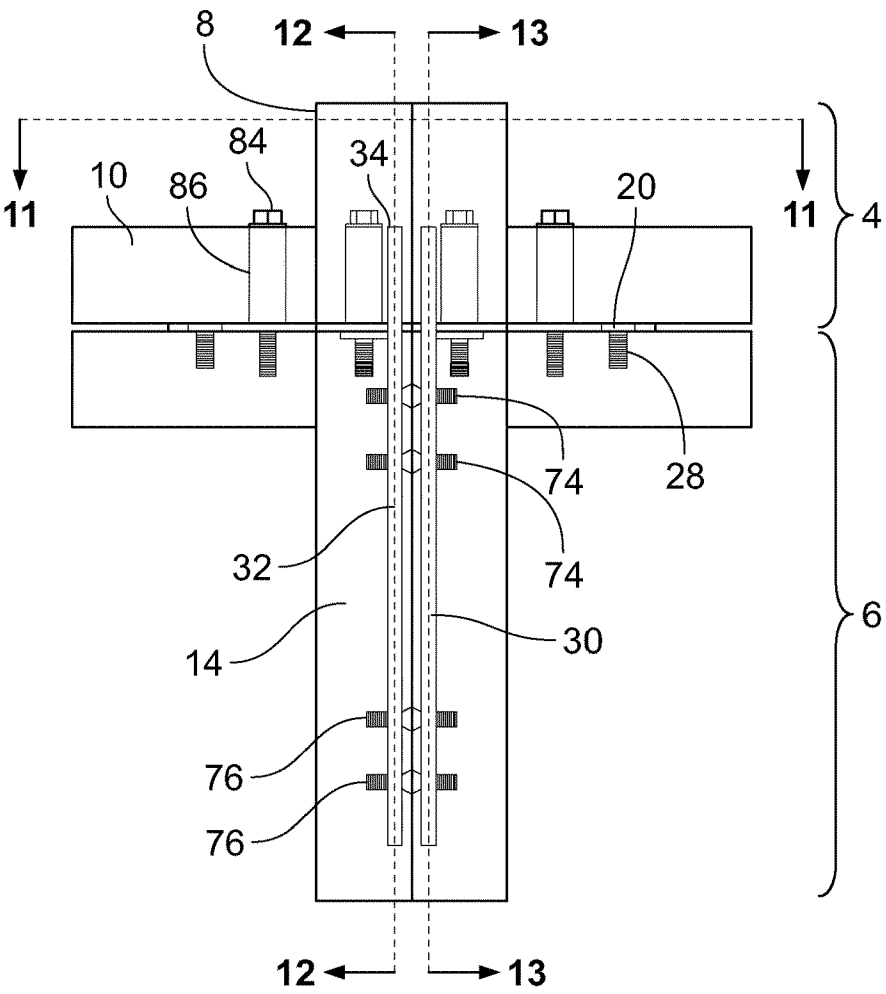
FIG. 10 is a side elevation view of a modular frame assembly shown in FIG. 9.
Figure 9:
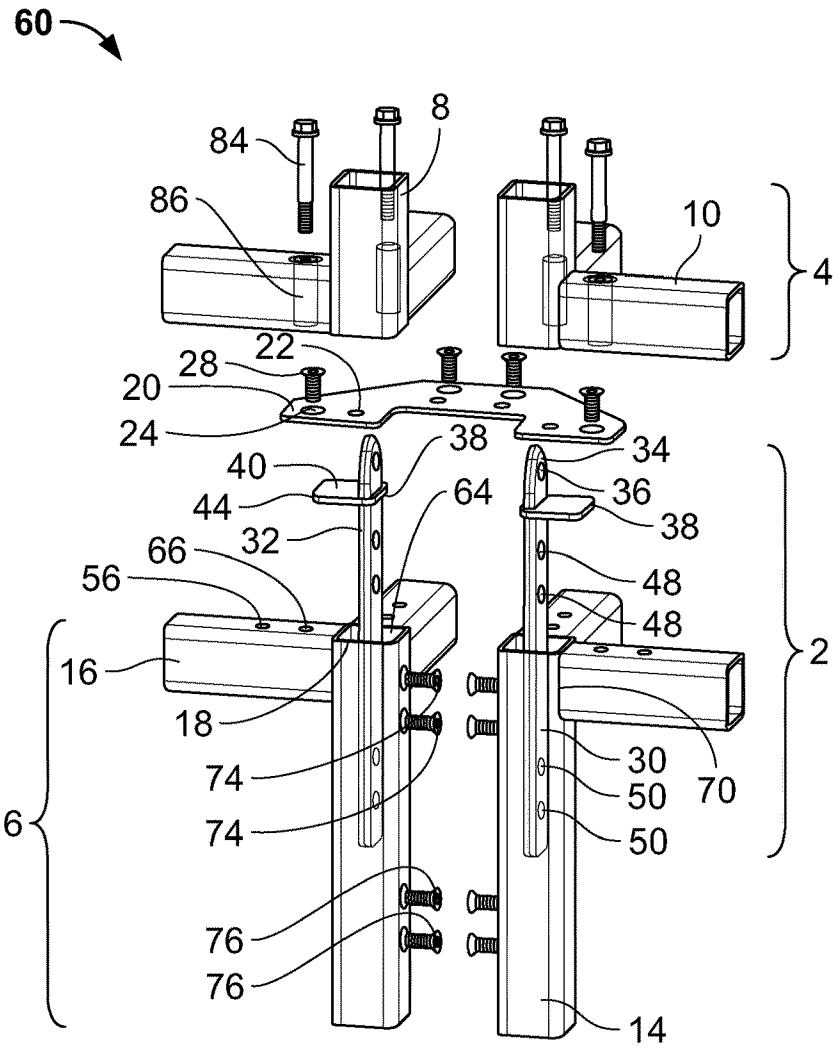
FIG. 9 is an exploded perspective view of another embodiment of a modular frame assembly having partial section of four modules, along with another embodiment of a locating pin assembly, in accordance with the specification.

FIGS. 9-13 relate to an embodiment of a modular assembly 60 similar to the embodiment shown in FIG. 3, and utilizes a similar gusset plate 20. However, in FIGS. 9-13, the pin 30 used has a planar stop plate 40 rather than a ledge 52 as a stop 38. FIG. 9 shows an exploded perspective view of such a modular assembly 60, while FIG. 10 an assembled modular assembly 60 with the locating pin assembly 2 being shown using a shade. As can be seen in FIG. 10, the flat quadrilateral-type plate like section 32 is positioned close to the surface of the second-modular-frame-first-hollow-tubular-member 14 having the first and second apertures (78, 80). Hence, when two adjacent modular assemblies 60 (each having a first and second modular frame 4, 6) are coupled, the pin 30 in each modular assembly 60 is adjacent to each other with the flat quadrilateral-type plate like section 32 in one modular assembly 60 facing the flat quadrilateral-type plate like section 32 in another adjacent modular assembly 60.

Figure 11:
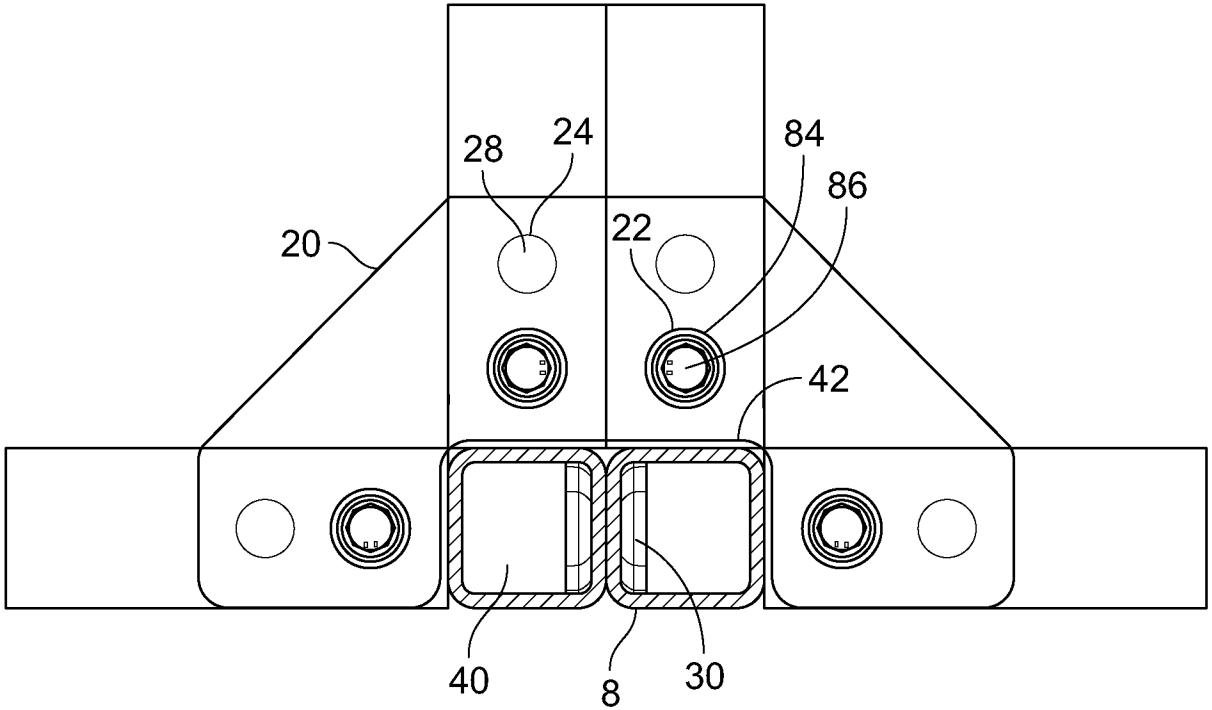
FIG. 11 is a plan view of a modular frame assembly shown in FIG. 9.

FIG. 11 shows a planar cross-sectional view of the embodiment shown in FIG. 9, and shows on the gusset plate 20 is positioned in between the beams (10, 16), along with alignment of the beams (10, 16) and columns (8, 14). In addition, FIG. 11 shows that the planar stop plate 40 is positioned in between the columns (8, 14) with each pin 30 being adjacent to each other.

FIGS. 12 and 13 show an elevational view of the two modular assemblies 60 to show the positioning of the pin 30 in the modular assemblies 60.

FIGS. 14-17 relate to an embodiment of a modular assembly 60 similar to the embodiment shown in FIG. 1, and utilizes a similar gusset plate 20. However, in FIGS. 14-17, the pin 30 used is similar to the pin 30 disclosed in FIGS. 9-13, and the reader is referred to the relevant sections in the specification for further understanding. The other features of the pin 30, gusset plate 20 and coupling to the first and second modular frame (4, 6) is similar to the embodiments disclosed in FIG. 1, and the reader is referred to the relevant sections in the specification for further understanding.

FIGS. 18-22 relate to still another embodiment of a modular frame assembly 60. The difference between the embodiment shown in FIGS. 18-22 and FIGS. 14-17 is that in FIGS. 18-22, the modular frames (4, 6) only have a single second-modular-frame-first-beam 16 rather than a pair of second-modular-frame-first-beams 16 as shown in FIGS. 14-17. In addition, the gusset plate 20 in the embodiment shown in FIGS. 18-22 is formed by a rectangular plate with one edge of the rectangular plate functioning similar to the cutout 42 in the gusset plate 20 shown in FIGS. 14-17. Furthermore, the gusset plate 20 shown in FIGS. 18-22 has a width similar to the width of the second-modular-frame-first-beam 16.

Figure 19:
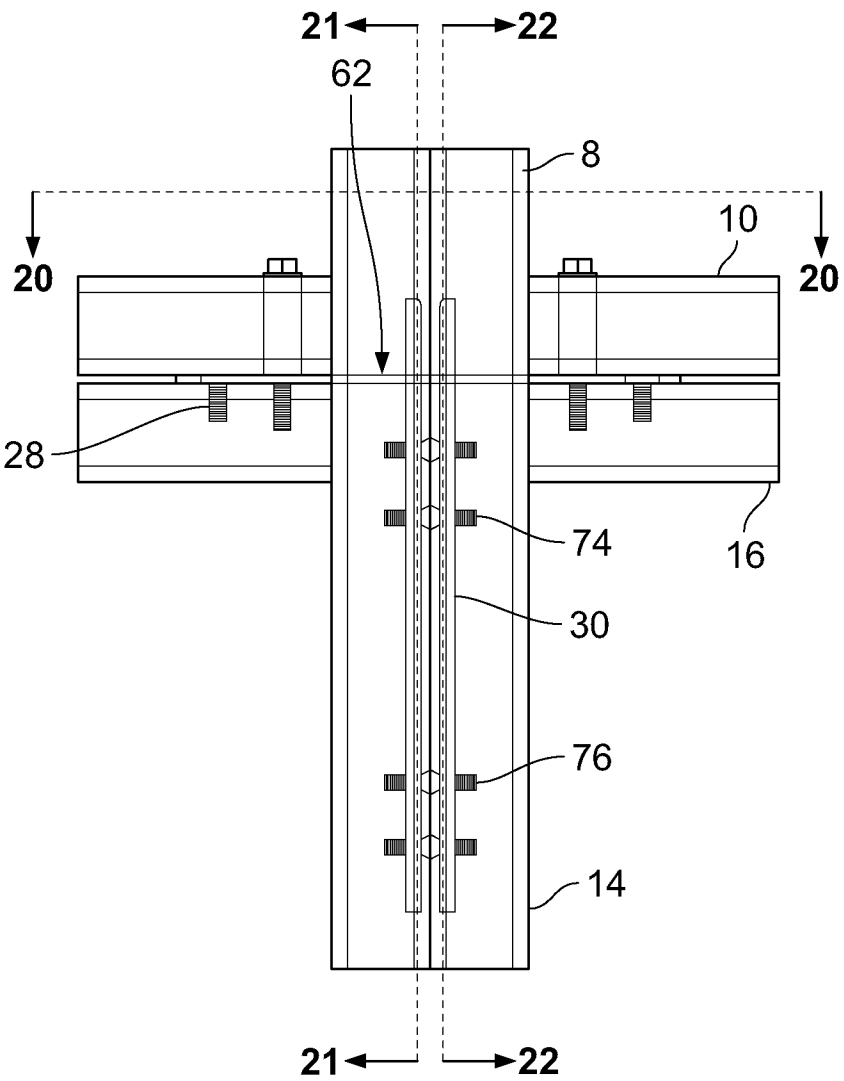
FIG. 19 is a side elevation view of a modular frame assembly shown in FIG. 18.
Figure 18:
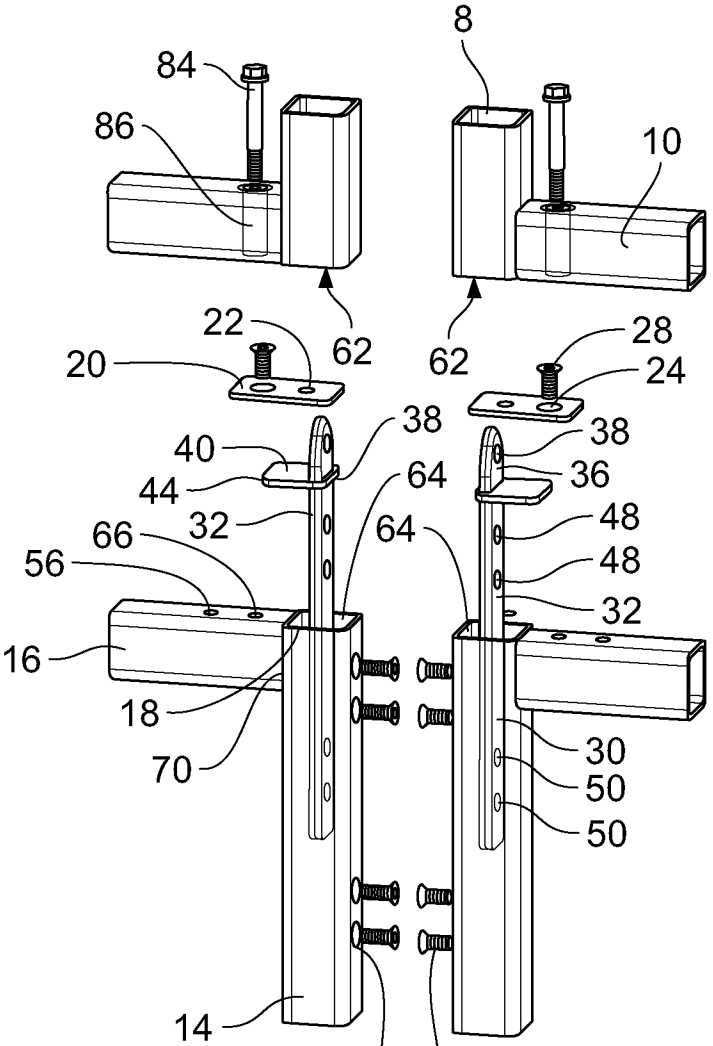
FIG. 18 is an exploded perspective view of another embodiment of a modular frame assembly having partial section of four modules, along with another embodiment of a locating pin assembly, in accordance with the specification.
Figure 22:
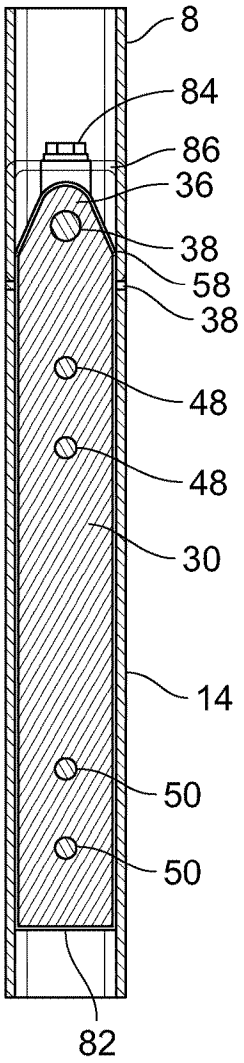
FIG. 22 is an elevational second side view of a modular frame assembly shown in FIG. 18.
Figure 21:
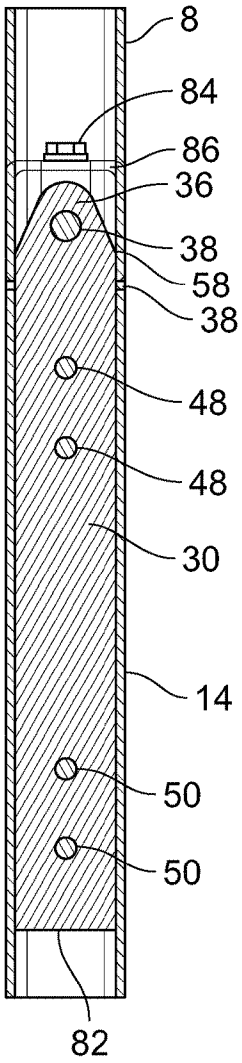
FIG. 21 is an elevational first side view of a modular frame assembly shown in FIG. 18.
Figure 20:
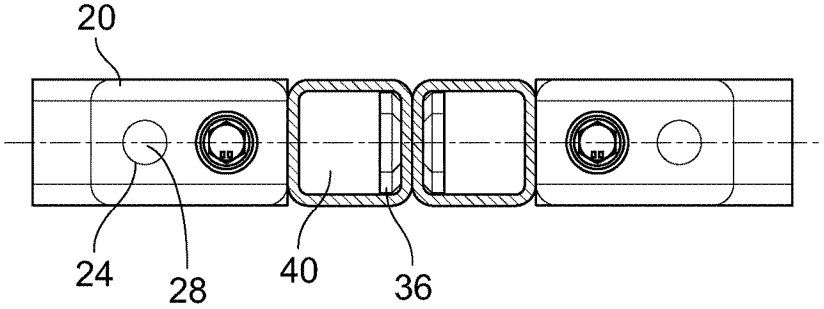
FIG. 20 is a plan view of a modular frame assembly shown in FIG. 18.

FIG. 19 shows a modular assembly 60 formed upon assembling the modular frames (4, 6) with the locating pin assembly 2 shown in FIG. 18. FIG. 20 shows a planar view of the modular assembly 60 shown in FIG. 19, and the positioning of the gusset plate 20 on the beams (10, 16).

FIG. 23-26 relate to still another further embodiment of a modular frame assembly 60. The difference between the embodiment shown in FIGS. 23-26 and FIGS. 14-17 is that in FIGS. 23-26, the modular frames (4, 6) have three second-modular-frame-first-beams 16 rather than a pair of second-modular-frame-first-beams 16 as shown in FIGS. 14-17. Two of the second-modular-frame-first-beams 16 extend in opposing directions and are co-axial, while one of the second-modular-frame-first-beams 16 is perpendicular to the other two second-modular-frame-first-beams 16.

The gusset plate 20 used in the embodiment disclosed in FIGS. 23-26 is similar to the gusset plate 20 used in the embodiment disclosed in FIG. 3; however, it is sized such that the cutout 42 in the gusset plate 20 disclosed in the embodiment of FIGS. 23-26 permits a single planar stop plate 40 of a single pin 30. In addition, the gusset plate 20 contacts and sits on each of the three second-modular-frame-first-beams 16, and used for coupling each of the three first-modular-frame-first-beam 10 to the corresponding and aligning three second-modular-frame-first-beams 16 for forming a modular assembly 60.

Figure 24:
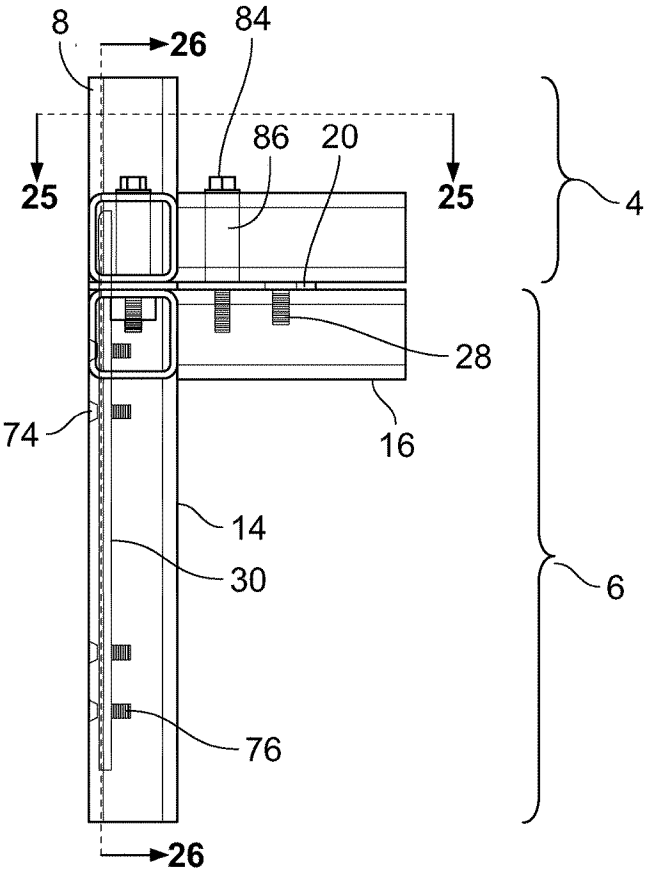
FIG. 24 is a side elevation view of a modular frame assembly shown in FIG. 23.
Figure 23:
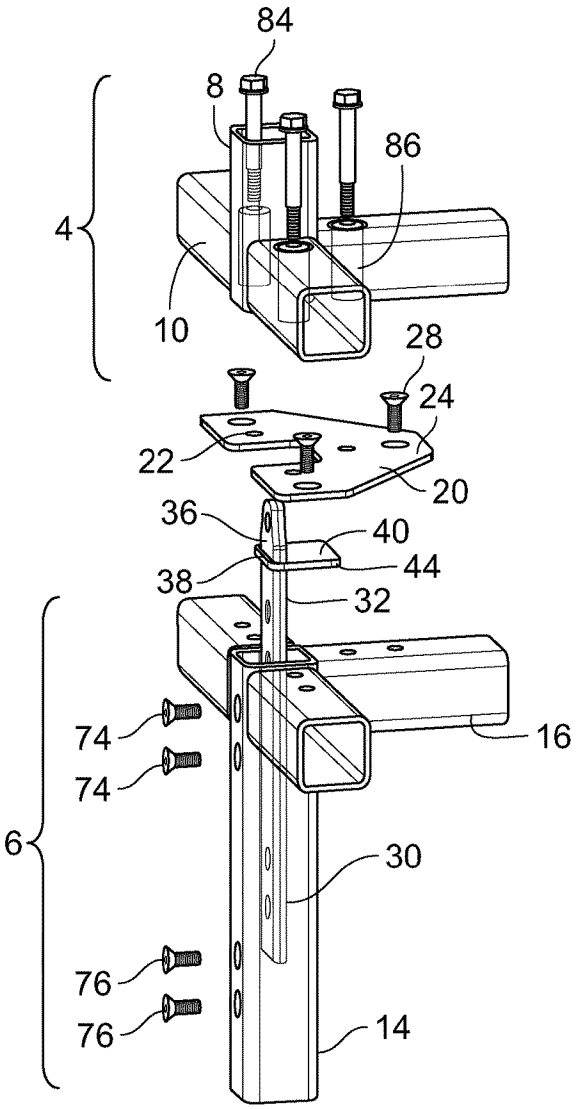
FIG. 23 is an exploded perspective view of another embodiment of a modular frame assembly having partial section of two modules, along with another embodiment of a locating pin assembly, in accordance with the specification.
Figure 26:
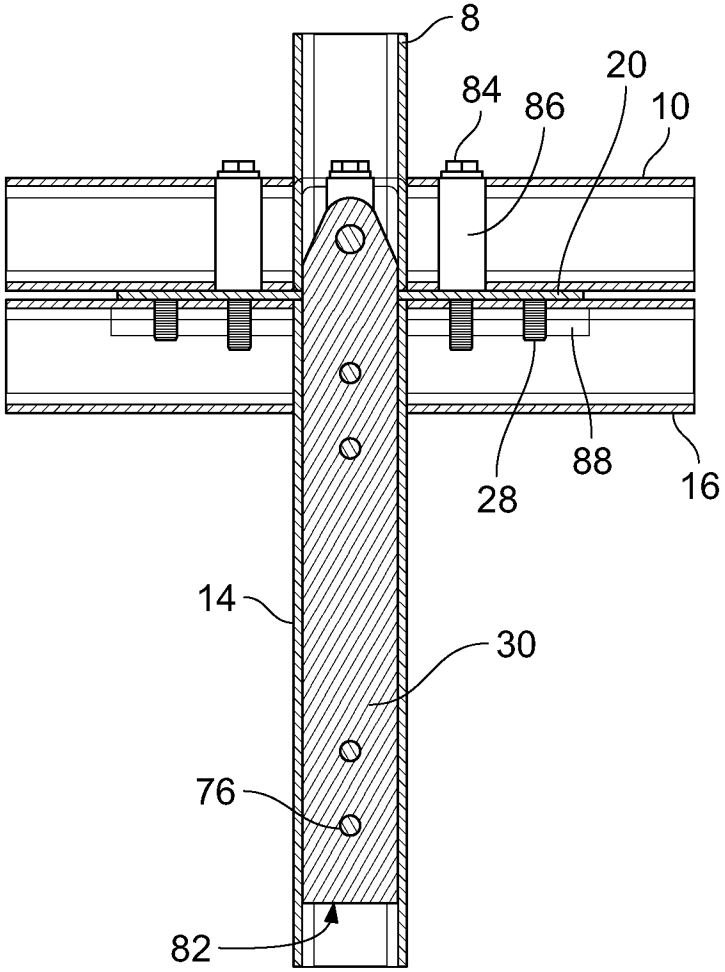
FIG. 26 is an elevational side view of a modular frame assembly shown in FIG. 23.
Figure 25:
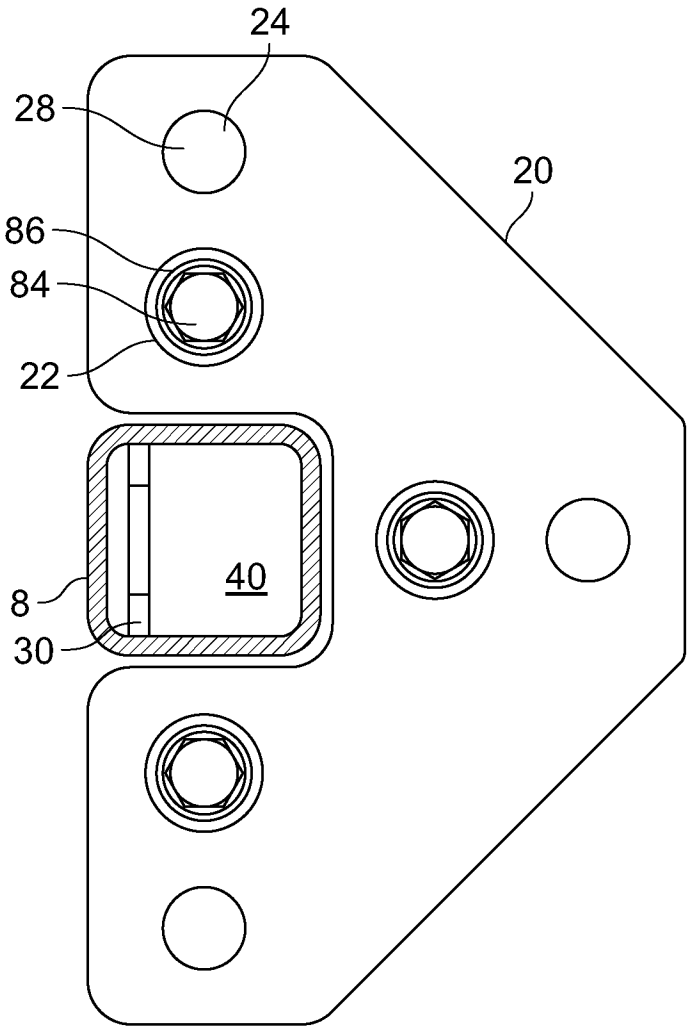
FIG. 25 is a plan view of a modular frame assembly shown in FIG. 23.

FIG. 24 discloses an assembled side elevational view of the embodiment of the modular assembly 60 shown in FIG. 23. FIG. 25 shows a plan view of the modular assembly 60 and how the gusset plate 20 sits on the beams (10, 16). FIG. 26 shows a front elevational view of an assembled modular assembly 60. In addition, as shown in FIG. 26, weld blocks 88 (as discussed with reference to FIG. 2) can also be used in the second-modular-frame-first-beams 16 for forming the modular assembly 60.

FIG. 27-31 shows another further embodiment of a modular frame assembly 60. In the embodiment shown in FIGS. 27-31, two adjacent modular assemblies 60, as shown in FIGS. 23-26, are coupled form a larger modular assembly 60. In the embodiment shown in FIGS. 27-31, the gusset plate 20 used is similar to the gusset plate 20 disclosed in FIG. 7, and the reader is directed to the relevant sections of the specification for further understanding. The gusset plate 20 is octagonal in shape, and contacts, sits on and coupled to each of the six second-modular-frame-first-beams 16, which can help to affix the modular assembly 60 together. The cutout 42 in the gusset plate 20 is rectangular (as opposed to being a square as in FIG. 7) to accommodate the two pins 30 and the planar stop plate 40 of the two pins 30, with the structure shown in FIG. 27 being assembled together to form the modular assembly 60 shown in FIG. 28.

Figure 28:
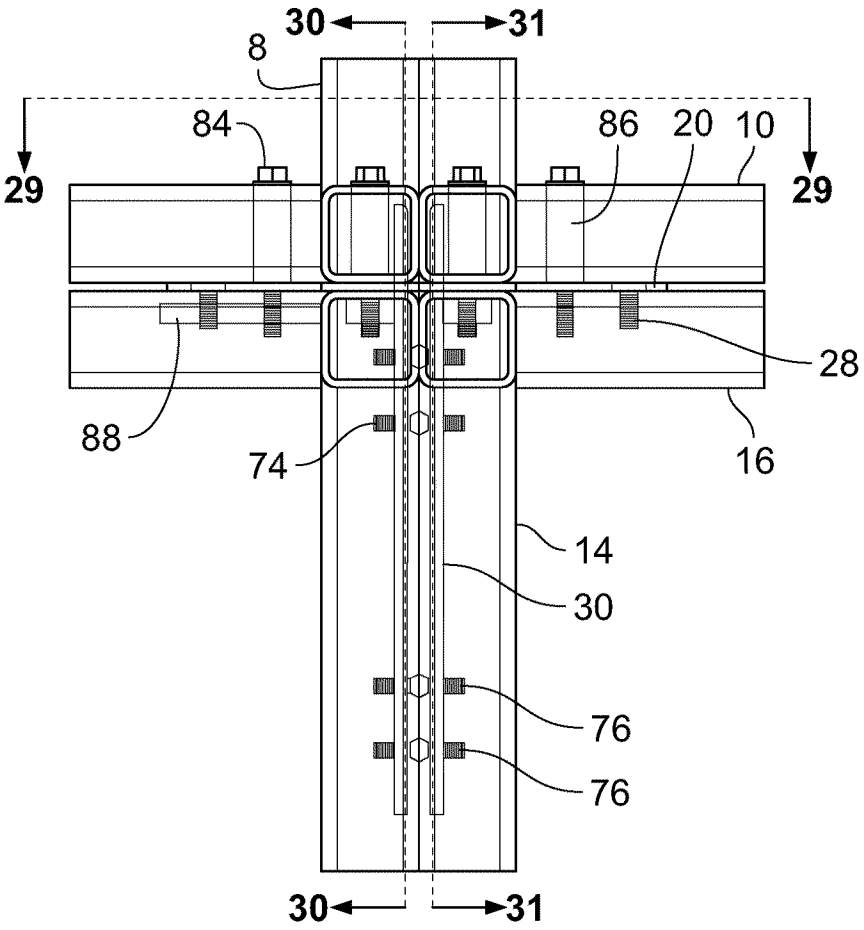
FIG. 28 is a side elevation view of a modular frame assembly shown in FIG. 27.
Figure 27:
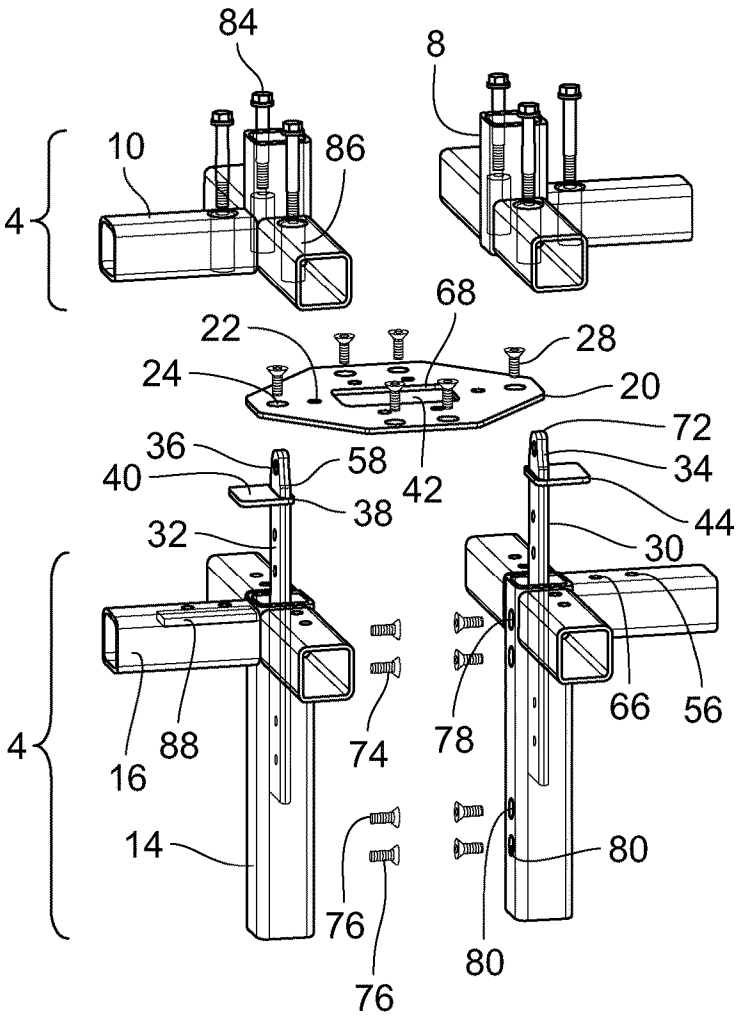
FIG. 27 is an exploded perspective view of another embodiment of a modular frame assembly having partial section of four modules, along with another embodiment of a locating pin assembly, in accordance with the specification.
Figure 29:
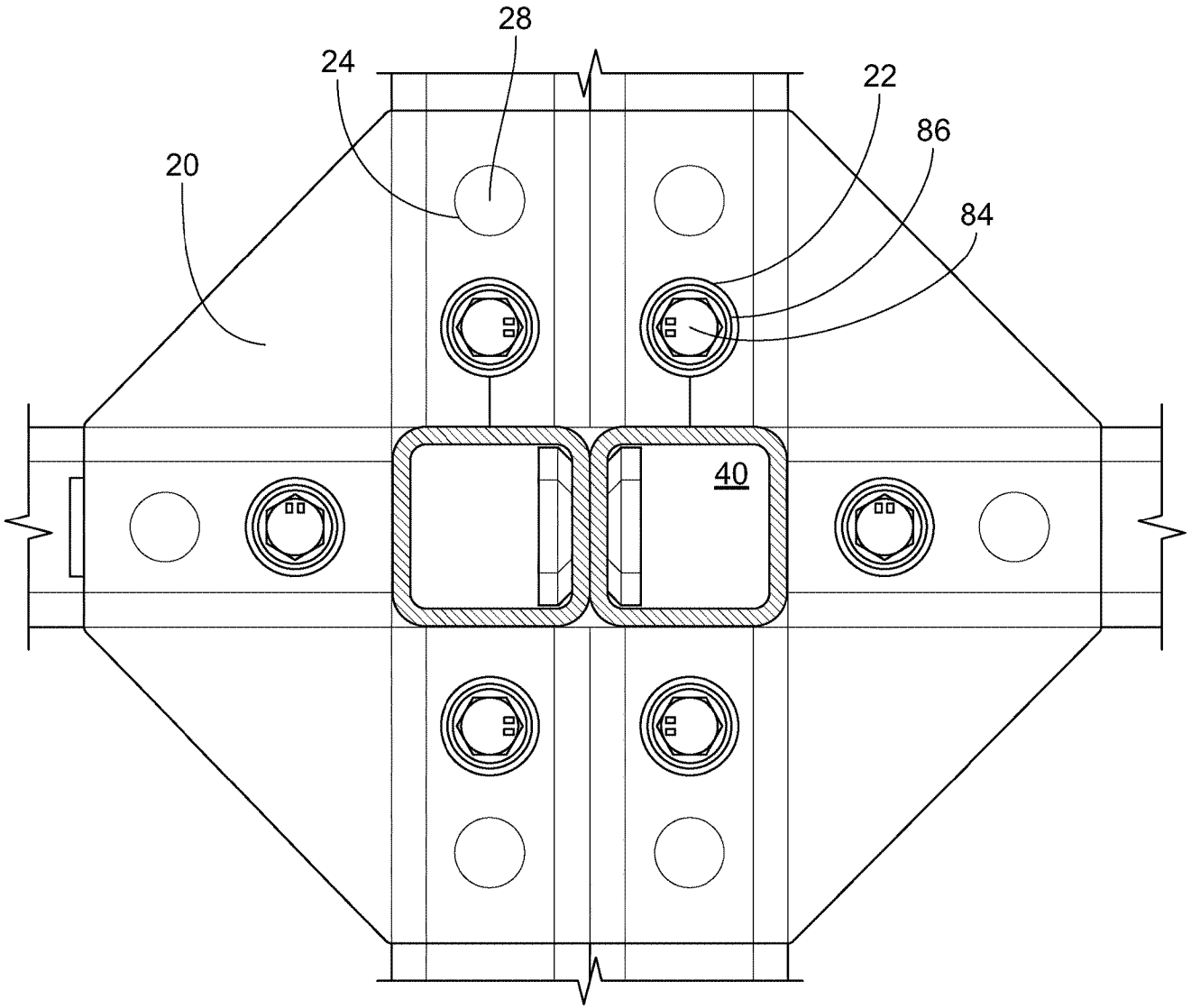
FIG. 29 is a plan view of a modular frame assembly shown in FIG. 27.
Figure 31:
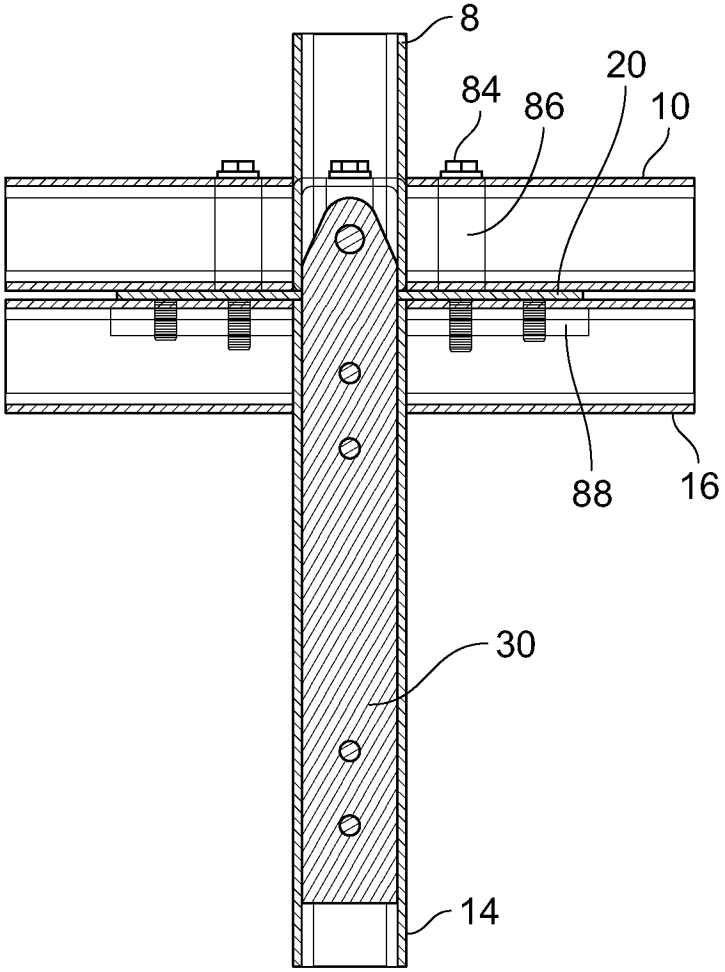
FIG. 31 is another elevational side view of a modular frame assembly shown in FIG. 27.
Figure 30:
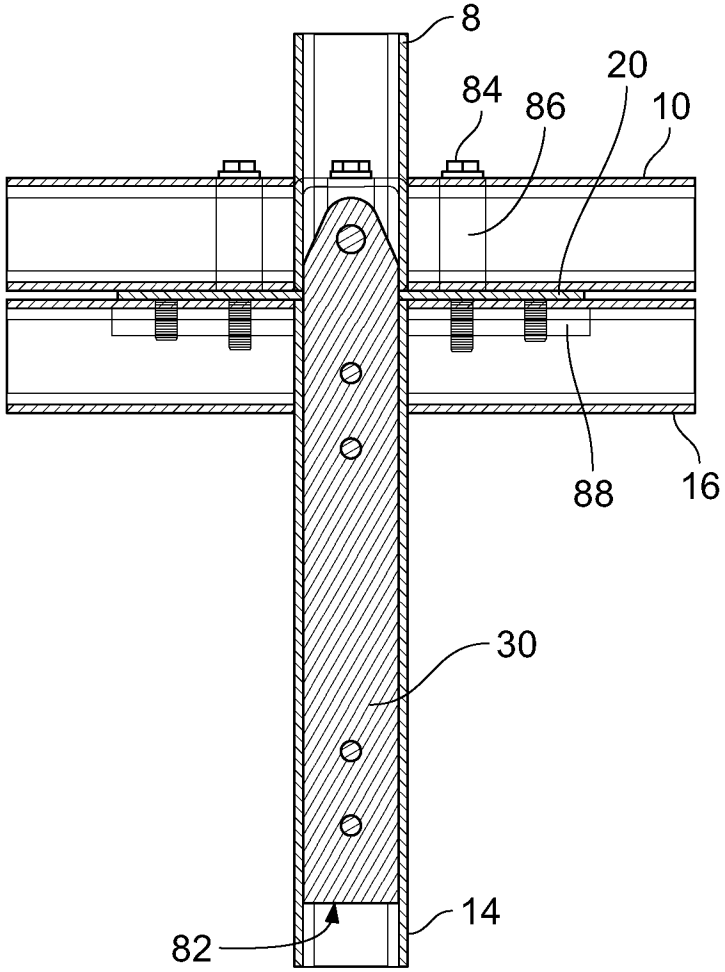
FIG. 30 is an elevational side view of a modular frame assembly shown in FIG. 27.

FIG. 29 shows a planar view of the modular assembly of FIG. 28, along with alignment of the beams (10, 16), columns (8, 14), the gusset plate 20 and the pins 30. FIGS. 30 and 31 show side elevational views of two modular assemblies 60 (each having a first and second modular frame 4, 6) as shown in FIG. 27, upon assembly. As shown in FIGS. 27, 28, 30 and 31 weld blocks 88 as disclosed in FIG. 2 can be used for improving the structural integrity of the modular assembly 60.

Certain adaptations and modifications of the described embodiments can be made. Therefore, the above discussed embodiments are considered to be illustrative and not restrictive.

PARTS LIST

| Num. | Description |
|---|---|
| 2 | Locating pin assembly |
| 4 | 1st modular frame |
| 6 | 2nd modular frame |
| 8 | first-modular-frame-first-hollow-tubular-member |
| 10 | first-modular-frame-first-beam |
| 12 | First end of 8 |
| 14 | second-modular-frame-first-hollow-tubular-member |
| 16 | second-modular-frame-first-beam |
| 18 | First end of 14 |
| 20 | first gusset plate |
| 22 | first gusset plate aperture |
| 24 | Second gusset plate aperture |
| 26 | First fastening means |
| 28 | Second fastening means |
| 30 | pin |
| 32 | flat quadrilateral-type plate like section |
| 34 | flat inverted conically shaped section |
| 36 | Hoisting aperture |
| 38 | stop |
| 40 | Planar stop plate |
| 42 | Cutout on gusset plate |
| 44 | One or more edges of planar stop plate |
| 46 | one or more edges of 14 |
| 48 | First orifice in 32 |
| 50 | Second orifice in 32 |
| 52 | ledge |
| 54 | first-modular-frame-first-beam-first-aperture |
| 56 | second-modular-frame-first-beam-first-aperture |
| 58 | first end of 32 |
| 60 | coupled modular frame unit |
| 62 | Opening at 12 |
| 64 | Opening at 18 |
| 66 | second-modular-frame-first-beam-second-aperture |
| 68 | edge of cutout |
| 70 | Edge of 16 |
| 72 | Apex of 34 |
| 74 | third fastening means |
| 76 | Fourth fastening means |
| 78 | 1st aperture in 14 |
| 80 | 2nd aperture in 14 |
| 82 | Second end of 32 |
| 84 | Threaded bolt |
| 86 | Compression sleeve |
| 88 | Weld block |
| 90 | Weld block 1st aperture |
| 92 | Weld block 2nd aperture |

What is claimed is:

1. A modular frame assembly comprising:

a first modular frame coupled to a second modular frame with a locating pin assembly sandwiched between the first modular frame and the second modular frame, the first modular frame having a first-modular-frame-first-hollow-tubular-member and a first-modular-frame-first-beam coupled at a first end of the first-modular-frame-first-hollow-tubular-member, and the second modular frame having a second-modular-frame-first-hollow-tubular-member and a second-modular-frame-first-beam coupled at a first end of the second-modular-frame-first-hollow-tubular-member, wherein the locating pin assembly comprises:

a first gusset plate positioned between the first modular frame and the second modular frame, the first gusset plate in contact with the first-modular-frame-first-beam on a first face of the first gusset plate and the second-modular-frame-first-beam on a second face of the first gusset plate, the first gusset plate having a first gusset plate aperture and a second gusset plate aperture, the first gusset plate aperture configured to receive a first fastening means engaging a first-modular-frame-first-beam-first-aperture coupling the first-modular-frame-first-beam to the first gusset plate, and the second gusset plate aperture configured to receive a second fastening means engaging a second-modular-frame-first-beam-first-aperture coupling the second-modular-frame-first-beam to the first gusset plate; and a pin engaging the first gusset plate, the first modular frame and the second modular frame, the pin having a flat quadrilateral plate section coupled to an inverted V-shaped section, the inverted V-shaped section coupled to a first end of the flat quadrilateral plate section, the flat quadrilateral plate section engaging the end of the second-modular-frame-first-hollow-tubular-member, and the inverted V-shaped section engaging the end of the first-modular-frame-first-hollow-tubular-member.

2. The modular frame assembly according to claim 1, wherein the inverted V-shaped section has a hoisting aperture.

3. The modular frame assembly according to claim 2, wherein the hoisting aperture is formed proximate to an apex of the inverted V-shaped section.

4. The modular frame assembly according to claim 1, further comprising a stop coupled to the flat quadrilateral plate section.

5. The modular frame assembly according to claim 4, wherein the stop is a ledge, the ledge sized to sit at the first end of the second-modular-frame-first-hollow-tubular-member, and the ledge plate having a thickness equal to a thickness of the first gusset plate; and the first gusset plate having a cutout for receiving and aligning with one or more edges of the ledge.

6. The modular frame assembly according to claim 4, wherein the flat quadrilateral plate section having a first orifice and a second orifice, the first orifice formed intermediate a second end of the flat quadrilateral plate section and the stop, the first orifice being proximate to the stop and adapted for receiving a third fastening means, and the second orifice formed proximate to the second end of the flat quadrilateral plate section and adapted for receiving a fourth fastening means, wherein the third fastening means engages a second-modular-frame-first-hollow-tubular-member-first-opening and the first orifice, and the fourth fastening means engages a second-modular-frame-first-hollow-tubular-member-second-opening and the second orifice to affix the flat quadrilateral plate section to the second-modular-frame-first-hollow-tubular-member.

7. The modular frame assembly according to claim 4, wherein the stop is positioned proximate to a first end of the flat quadrilateral plate section, the first end of the flat quadrilateral plate section being coupled to the inverted V-shaped section.

8. The modular frame assembly according to claim 4, wherein the stop is a planar stop plate, the planar stop plate sized to sit at the first end of the second-modular-frame-first-hollow-tubular-member, and the planar stop plate having a thickness equal to a thickness of the first gusset plate; and the first gusset plate having a cutout for receiving and aligning with one or more edges of the planar stop plate.

9. The modular frame assembly according to claim 8, wherein the one or more edges of the planar stop plate longitudinally align with one or more edges of the second-modular-frame-first-hollow-tubular-member.

* * * * *